US005264005A

United States Patent [19]

Blythe

[11] Patent Number: 5,264,005

[45] Date of Patent: Nov. 23, 1993

[54] TWO-CYCLE LUBRICANTS AND METHODS OF USING THE SAME

[75] Inventor: Glen H. Blythe, Mentor, Ohio

[73] Assignee: The Lubrizol Corporation, Wickliffe, Ohio

[21] Appl. No.: 744,618

[22] Filed: Aug. 9, 1991

[51] Int. Cl.[5] ..... C10M 141/02; C10M 141/06

[52] U.S. Cl. ..... 44/388; 44/408; 44/409; 44/414; 44/419; 44/438; 44/439; 44/443; 252/52 R; 252/54.6; 252/51.5 A; 252/51.5 R; 252/56 R

[58] Field of Search ..... 252/51.5 R, 51.5 A, 252/54.6, 52 R, 56 R; 44/388, 414, 419, 408, 409, 438, 439, 443

[56] References Cited

U.S. PATENT DOCUMENTS

| | | | |
|---|---|---|---|
| 2,350,145 | 5/1944 | Backoff et al. | 44/58 |
| 2,431,776 | 12/1947 | Skinner | 252/118 |
| 2,896,593 | 7/1959 | Riemenschneider | 123/1 |
| 3,240,575 | 3/1966 | Miller et al. | 44/66 |
| 3,251,853 | 5/1966 | Hoke | 260/309.6 |
| 3,326,801 | 6/1967 | Schlobohm et al. | 252/51.5 |
| 3,337,459 | 8/1967 | Ford | 252/51.5 |
| 3,405,064 | 10/1968 | Miller | 252/51.5 |
| 3,429,674 | 2/1969 | Hoke | 44/58 |
| 3,753,905 | 8/1973 | Souillard et al. | 252/33.4 |
| 3,838,049 | 9/1974 | Souillard et al. | 252/32.7 |
| 3,857,791 | 12/1974 | Marcellis et al. | 252/51.5 A |
| 3,871,837 | 3/1975 | Bedague et al. | 252/52 A |
| 4,025,316 | 5/1977 | Stover | 44/425 |
| 4,100,082 | 7/1978 | Clason et al. | 252/33.4 |
| 4,200,545 | 4/1980 | Clason et al. | 252/33.4 |
| 4,231,757 | 11/1980 | Davis | 44/63 |
| 4,250,045 | 2/1981 | Coupland et al. | 252/32.7 |
| 4,320,020 | 3/1982 | Lange | 252/51.5 |
| 4,320,021 | 3/1982 | Lange | 252/51.5 |
| 4,347,148 | 8/1982 | Davis | 252/51.5 |
| 4,379,065 | 4/1983 | Lange | 252/51.5 |
| 4,394,135 | 7/1983 | Andress | 44/71 |
| 4,425,138 | 1/1984 | Davis | 44/58 |
| 4,663,063 | 5/1987 | Davis | 252/51.5 |
| 4,705,643 | 11/1987 | Nemo | 252/51.5 |
| 4,708,809 | 11/1987 | Davis | 252/33.4 |
| 4,724,091 | 2/1988 | Davis | 252/33.4 |
| 4,740,321 | 4/1988 | Davis et al. | 252/52 R |
| 4,804,389 | 2/1989 | Johnston et al. | 44/347 |
| 4,994,196 | 2/1991 | Kagaya et al. | 252/32.5 |

*Primary Examiner*—Margaret Medley

*Attorney, Agent, or Firm*—Joseph P. Fischer; Frederick D. Hunter, Sr.; James L. Cordek

[57] ABSTRACT

This invention relates to a two-cycle engine lubricant composition, comprising (A) at least one dispersant, (B) at least one reaction product of a fatty acid and a polyamine, and (C) at least about 25% by weight of the composition of at least one varnish dissolver selected from (a) keto-alcohols, (b) carboxylic esters having up to a total of 24 carbon atoms and (c) alkoxy alcohols, and (D) at least about 15% by weight of the composition of at least one fluidizing oil, and a method, comprising the steps of introducing into a two-cycle internal combustion engine a fuel-lubricant mixture comprising a major amount of a fuel and a minor amount sufficient to increase compression or release stuck piston rings, of the two-cycle engine lubricant composition.

55 Claims, No Drawings

TWO-CYCLE LUBRICANTS AND METHODS OF USING THE SAME

FIELD OF THE INVENTION

This invention relates to a method and compositions for improving compression or releasing stuck rings of a two cycle engine.

BACKGROUND OF THE INVENTION

Over the past several decades the use of spark-ignited two-cycle (two-stroke) internal combustion engines has steadily increased. They are presently found in power lawn mowers and other power-operated garden equipment, power chain saws, pumps, electrical generators, marine outboard engines, snowmobiles, motorcycles and the like.

The increasing use of two-cycle engines coupled with increasing severity of the conditions in which they have operated has led to an increasing demand for oils to adequately lubricate such engines. Among the problems associated with lubrication of two-cycle engines are piston ring sticking, rusting, lubrication failure of connecting rod and main bearings and the general formation on the engine's interior surfaces of carbon and varnish deposits. The formation of varnish is a problem since the build-up of varnish on piston and cylinder walls is believed to ultimately result in ring sticking which leads to failure of the sealing function of piston rings. Such seal failure causes loss of cylinder compression which is particularly damaging in two-cycle engines because they depend on suction to draw the fuel charge into the engine cylinder Thus, ring sticking can lead to loss of power and deterioration in engine performance and unnecessary consumption of fuel and/or lubricant. Spark plug fouling and engine port plugging problems also occur in two-cycle engines.

The unique problems and techniques associated with the lubrication of two-cycle engines has led to the recognition by those skilled in the art of two-cycle engine lubricants as a distinct lubricant type. See, for example, U.S. Pat. Nos. 3,085,975; 3,004,837; and 3,753,905.

Aminophenols are useful in two-cycle engines. U.S. Pat. Nos. 4,320,020 and 4,,320,021 issued to Lange, relate to aminophenols and their use in lubricants. Aminophenols have been used in combination with dispersants and detergents. U.S. Pat. Nos. 4,100,082 and 4,200,545, both issued to Clason et al, relate to aminophenols used in combination with neutral or basic metal salts and amine dispersants in two-cycle lubricants. U.S. Pat. No. 4,379,065 issued to Lange relates to aminophenols used in combination with ashless ester dispersants. U.S. Pat. No. 4,425,138 relates to aminophenols used in lubricant-fuel mixtures for two-cycle engines.

U.S. Pat. Nos. 4,663,063 and 4,724,092 issued to Davis relate to a combination of an alkyl phenol and an amino compound in two-cycle engines. The former relates to an alkyl phenol together with an amino compound other than an aminophenol. The latter relates to an alkyl phenol together with an aminophenol.

SUMMARY OF THE INVENTION

This invention relates to a method, comprising the steps of:

introducing into a two-cycle internal combustion engine a fuel-lubricant mixture comprising a major amount of a fuel and a minor amount sufficient to increase compression or release stuck piston rings, of a composition comprising (A) at least one dispersant, (B) at least one reaction product of a fatty acid and a polyamine, (C) at least 25% by weight of the composition of at least one varnish dissolver selected from (a) keto-alcohols, (b) carboxylic esters having up to a total of 24 carbon atoms, (c) alkoxy alcohols, and (D) at least about,15% by weight of the composition of at least one fluidizing oil.

The invention also contemplates a two-cycle engine lubricant composition, comprising (A) at least one dispersant, (B) at least one reaction product of a fatty acid and a polyamine, and (C) at least about 25% by weight of the composition of at least one varnish dissolver selected from (a) keto-alcohols, (b) carboxylic esters having up to a total of 24 carbon atoms and (c) alkoxy alcohols, and (D) at least about 15% by weight of the composition of at least one fluidizing oil.

The method and the compositions of the present invention improve compression, release of stuck rings and improve general engine cleanliness of two cycle engines.

DETAILED DESCRIPTION OF THE INVENTION

The term "hydrocarbyl" includes hydrocarbon, as well as substantially hydrocarbon groups. Substantially hydrocarbon describes groups which contain non-hydrocarbon substituents which do not alter the predominately hydrocarbon nature of the group.

Examples of hydrocarbyl groups include the following:

(1) hydrocarbon substituents, that is, aliphatic (e.g., alkyl or alkenyl), alicyclic (e.g., cycloalkyl, cycloalkenyl) substituents, aromatic-, aliphatic- and alicyclic-substituted aromatic substituents and the like as well as cyclic substituents wherein the ring is completed through another portion of the molecule (that is, for example, any two indicated substituents may together form an alicyclic radical);

(2) substituted hydrocarbon substituents, that is, those substituents containing non-hydrocarbon groups which, in the context of this invention, do not alter the predominantly hydrocarbon substituent; those skilled in the art will be aware of such groups (e.g., halo (especially chloro and fluoro), hydroxy, alkoxy, mercapto, alkylmercapto, nitro, nitroso, sulfoxy, etc.);

(3) hetero substituents, that is, substituents which will, while having a predominantly hydrocarbon character within the context of this invention, contain other than carbon present in a ring or chain otherwise composed of carbon atoms. Suitable heteroatoms will be apparent to those of ordinary skill in the art and include, for example, sulfur, oxygen, nitrogen and such substituents as, e.g., pyridyl, furyl, thienyl, imidazolyl, etc. In general, no more than about 2, preferably no more than one, non-hydrocarbon substituent will be present for every ten carbon atoms in the hydrocarbyl group. Typically, there will be no such non-hydrocarbon substituents in the hydrocarbyl group. Therefore, the hydrocarbyl group is purely hydrocarbon.

When a substituent is defined as having an average number of carbon atoms, that average number of carbon atoms is based on number average molecular weight. However, the substituent does not have to have an average number of carbon atoms. The substituent may have a specific single number of carbon atoms, e.g., 18 carbon atoms.

(A) Dispersants

The methods and compositions of the present invention use (A) a dispersant. In one embodiment, the dispersants are selected from the group consisting of (A-1) aminophenols, (A-2) reaction products of nitrophenols and amino compounds, (A-3) nitrogen-containing carboxylic dispersants, (A-4) amine dispersants, (A-5) ester dispersants and (A-6) Mannich dispersants.

(A-1) Aminophenols

The term "phenol" is used in this specification in its art-accepted generic sense to refer to hydroxyaromatic compounds having at least one hydroxyl group bonded directly to a carbon of an aromatic ring. The aminophenols used in this invention contain at least one of each of the following substituents: an amino group, a hydroxyl group and an R group as defined herein. Each of the foregoing groups must be attached to a carbon atom which is a part of an aromatic nucleus in the Ar moiety. They need not, however, each be attached to the same aromatic ring if more than one aromatic nucleus is present in the Ar moiety.

The aromatic moiety, Ar, of the aminophenols can be a single aromatic nucleus such as a benzene nucleus, a pyridine nucleus, a thiophene nucleus, a 1,2,3,4-tetrahydronaphthalene nucleus, etc., or a polynuclear aromatic moiety. Such polynuclear moieties can be of the fused type; that is, wherein at least two aromatic nuclei are fused at two points to another nucleus such as found in naphthalene, anthracene, the azanaphthalenes, etc. Such polynuclear aromatic moieties also can be of the linked type wherein at least two nuclei (either mono or polynuclear) are linked through bridging linkages to each other. Such bridging linkages can be chosen from the group consisting of carbon-to-carbon single bonds, ether linkages, keto linkages, sulfide linkages, polysulfide linkages of 2 to 6 sulfur atoms, sulfinyl linkages, sulfonyl linkages, methylene linkages, alkylene linkages, di-(lower alkyl)methylene linkages, lower alkylene ether linkages, alkylene keto linkages, lower alkylene sulfur linkages, lower alkylene polysulfide linkages of 2 to 6 carbon atoms, amino linkages, polyamino linkages and mixtures of such divalent bridging linkages. In certain instances, more than one bridging linkage can be present in Ar between aromatic nuclei. For example, a fluorene nucleus has two benzene nuclei linked by both a methylene linkage and a covalent bond. Such a nucleus may be considered to have 3 nuclei but only two of them are aromatic. Normally, Ar will contain only carbon atoms in the aromatic nuclei per se.

The single ring aromatic nucleus which can be the Ar moiety can be represented by the general formula: $ar(Q)_m$ wherein ar represents a single ring aromatic nucleus (e.g., benzene) of 4 to 10 carbon atoms, each Q independently represents a lower alkyl group, lower alkoxyl group, methylol or lower hydrocarbon-based substituted methylol, or halogen atom, and m is 0 to 3, preferably 2. As used in this specification and appended claims, "lower" refers to groups having 7 or less, preferably 1 to about 3 carbon atoms such as lower alkyl and lower alkoxyl groups. Halogen atoms include fluorine, chlorine, bromine and iodine atoms; usually, the halogen atoms are fluorine and chlorine atoms.

Examples of single ring Ar moiety include benzene moieties, such as 1,2,4-benzenetriyl; 1,2,3-benezenetriyl; 3-methyl-1,2,4-benzenetriyl; 2-methyl-5-ethyl-1,3,4-benzenetriyl; 3-propoxy-1,2,4,5-benzenetetrayl; 3-chloro-1,2,4(4-benzenetriyl; 1.2,3,5-benzenetetrayl; 3-cyclohexyl-1,2,4-benzenetriyl; and 3-azocyclopentyl-1.2,5-benzenetriyl, and pyridine moieties, such as 3,4,5-azabenzene; and 6-methyl-3,4,5-azabenzene.

When Ar is a polynuclear fused-ring aromatic moiety, it can be represented by the general formula: $ar \not\in ar \not\ni_{m'}(Q)_{mm'}$ wherein ar, Q and m are as defined hereinabove, m' is 1 to 4 and each $\not\in$ represents a pair of fusing bonds fusing two rings to make two carbon atoms part of the rings of each of two adjacent rings and mm' is the sum of m and m'. Specific examples of fused ring aromatic moieties Ar include: 1,4,8-naphthylene; 1,5,8-naphthylene; 3,6-dimethyl-4,5,8(1-azonaphthalene); 7-methyl-9-methoxy- 1,2,5,9-anthracenetetrayl; 3,10-phenathrylene; and 9-methoxy-benz(a)phenanthrene-5,6,8,12-yl.

When the aromatic moiety Ar is a linked polynuclear aromatic moiety it can be represented by the general formula: $ar(Lng\text{-}ar)_w(Q)_{mw}$ wherein w is an integer of 1 to about 20, ar is as described above with the proviso that there are at least 3 unsatisfied (i.e., free) valences in the total of ar groups, Q and m are as defined hereinbefore, mw is the sum of m and w, and each Lng is one or more of the above linkages.

Specific examples of Ar when it is linked polynuclear aromatic moiety include: 3,3',4,4',5-bibenzenetetrayl; di(3,4-phenylene)ether; 2,3-phenylene-2,6-naphthylenemethane; and 3-methyl, 9H-fluorene-1,2,4,5,8-yl; 212-di (3,4-phenylene)propane; sulfur-coupled 3 -methyl-1, 2, 4 -benzatriyl (having 1 to about 10 thiomethylphenylene groups); and amino-coupled 3-methyl-1,2,4-benzatriyl (having 1 to about 10 aminomethylphenylene groups).

Usually all these Ar moieties are unsubstituted except for the R and —OH groups (and any bridging groups).

For such reasons as cost, availability, performance, etc., the Ar moiety is normally a benzene nucleus, lower alkylene bridge benzene nucleus, or a naphthalene nucleus. Thus, a typical Ar moiety is a benzene or naphthalene nucleus having 3 to 5 unsatisfied valences, so that one or two of said valences may be satisfied by a hydroxyl group with the remaining unsatisfied valences being, insofar as possible, either ortho or para to a hydroxyl group. Preferably, Ar is a benzene nucleus having 3 to 4 unsatisfied valences so that one can be satisfied by a hydroxyl group with the remaining 2 or 3 being either ortho or para to the hydroxyl group.

Preferably, the aminophenol is represented by the formula $$(R)_a\text{—}\overset{\overset{(OH)_c}{|}}{Ar}\text{—}(NH_2)_b$$

wherein R is a hydrocarbyl substituent having an average of about 10 up to about 400 carbon atoms; (a) , (b) and (c) are each independently an integer from 1 up to 3 times the number of aromatic nuclei are present Ar with the proviso that the sum of (a) plus (b) plus (c) does not exceed the unsatisfied valencies of Ar; and Ar is independently an aromatic moiety which has from 0 to 3 substituents selected from the group consisting of lower alkyl, alkoxyl, nitro, halo or combinations of two or more thereof. The number of aromatic nuclei, fused, linked or both, in the above-described Ar can play a role in determining the integer values of a, b and c. For example, when Ar contains a single aromatic nucleus, a, b and c are each independently 1 to 4. When Ar contains two aromatic nuclei, a, b and c can each be an integer from 1 to 8, that is, up to three times the number of aromatic nuclei present (in naphthalene, 2). With a tri-nuclear aromatic moiety (Ar), a, b and c can each be an integer of 1 to 12. For instance, when Ar is a biphenyl or a naphthyl moiety, a, b and c can each independently be an integer of 1 to 8. The values of a, b and c are limited by the f act that their sum cannot exceed the total unsatisfied valences of Ar.

The aminophenols used in the present invention contain, directly bonded to the aromatic moiety Ar, a hydrocarbyl group (R) of at least about 10 aliphatic carbon atoms. Usually, the hydrocarbyl group has at least about 30, more typically, at least about 50 aliphatic carbon atoms and up to about 400, more typically, up to about 300 carbon atoms. In one embodiment, the hydrocarbyl group has a number average molecular weight Mn from about 400 to about 3000, preferably about 500 to about 2500, more preferably about 700 to about 1500. The number average molecular weight as well as the average number of carbons, where appropriate, are determined by gel permeation chromatography (GPC).

Illustrative hydrocarbyl groups containing at least ten carbon atoms are n-decyl, n-dodecyl, tatrapropenyl, n-octadecyl, oleyl, chlorooctadecyl, triicontanyl, etc. Generally, the hydrocarbyl groups R are derived from polyalkenes. The polyalkenes are homo- or interpolymers (e.g., copolymers, terpolymers) of mono- and diolefins having 2 to 10 carbon atoms, such as ethylene, propylene, butene-1, isobutene, butadiene, isoprene, 1-hexene, 1-octene, etc. Typically, these olefins are 1-monoolefins. The R groups can also be derived from the halogenated (e.g., chlorinated or brominated) analogs of such polyalkenes. The R groups can, however, be derived from other sources, such as monomeric high molecular weight alkenes (e.g., 1-tetracontene) and chlorinated analogs and hydrochlorinated analogs thereof, aliphatic petroleum fractions, particularly paraffin waxes and cracked and chlorinated analogs and hydrochlorinated analogs thereof, white oils, synthetic alkenes such as those produced by the Ziegler-Natta process (e.g., poly(ethylene) greases) and other sources known to those skilled in the art. Any unsaturation in the R groups may be reduced or eliminated by hydrogenation according to procedures known in the art.

Specific examples of the hydrocarbyl (R) groups containing an average of more than about 30 carbon atoms are the following: a mixture of poly(ethylene/-propylene) groups of about 35 to about 70 carbon atoms; a mixture of the oxidatively or mechanically degraded poly(ethylene/propylene groups of about 35 to about 70 carbon atoms; a mixture of poly(-propylene/1-hexene) groups of about 80 to about 150 carbon atoms; and a mixture of polybutene groups having an average of 50 to 75 carbon atoms. A preferred source of the group R are polybutenes obtained by polymerization of a $C_4$ refinery stream having a butene content of 35 to 75 weight percent and isobutene content of 30 to 60 weight percent in the presence of a Lewis acid catalyst such as aluminum trichloride or boron trifluoride.

The attachment of the hydrocarbyl group R to the aromatic moiety Ar of the aminophenols used in this invention can be accomplished by a number of techniques well known to those skilled in the art. One particularly suitable technique is the Friedel-crafts reaction, wherein an olefin (e.g., a polymer containing an olefinic bond, or halogenated or hydrohalogenated analog thereof, is reacted with a phenol. The reaction occurs in the presence of a Lewis acid catalyst (e.g., boron trifluoride and its complexes with ethers, phenols, hydrogen fluoride, etc., aluminum chloride, aluminum bromide, zinc dichloride, etc.). Methods and conditions for carrying out such reactions are well known to those skilled in the art. See, for example, the discussion in the article entitled, "Alkylation of Phenols" in Kirk-Othmer "Encyclopedia of Chemical Technology", Second Edition, Vol. 1, pages 894–895, Interscience Publishers, a division of John Wiley and Company, N.Y., 1963. other equally well known appropriate and convenient techniques for attaching the hydrocarbon-based group R to the aromatic moiety Ar will occur readily to those skilled in the art.

As mentioned, the aromatic moiety (Ar) may contain up to 3 optional substituents which are lower alkyl, lower alkoxyl, carboalkoxy methylol or lower hydrocarbon-based substituted methylol, nitro, nitroso, halo, amino, or combinations of two or more of these optional substituents. These substituents may be attached to a carbon atom which is part of the aromatic nucleus in Ar. They need not, however, be attached to the same aromatic ring if more than one ring is present in Ar.

In the preferred embodiment, the aminophenols used in this invention contain one each of the foregoing substituents (i.e., a, b and c are each one) and Ar is a single aromatic ring, preferably benzene. This preferred class of aminophenols can be represented by the formula

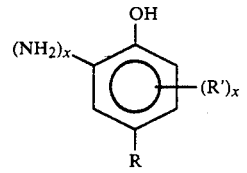

wherein R is defined above; R' is a member selected from the group consisting of lower alkyl, lower alkoxyl, carboalkoxy nitro, nitroso and halo; x is 0 or 1; and z is 0 or 1. Generally, the R group is located ortho or para to the hydroxyl group, and z is usually 0. Most often, there is only one amino group in the aminophenol used in the invention, i.e., x equals 0.

The aminophenols of the present invention can be prepared by a number of synthetic routes. For example, an aromatic hydrocarbon or a phenol may be alkylated and then nitrated to form an intermediate. The intermediate may be reduced by any means known to those in the art. The alkylated aromatic hydrocarbon nitro intermediate may be reacted with water to form hydroxylnitro alkylated aromatics which may then be reduced to aminophenols as is known to those skilled in the art.

Techniques for nitrating phenols are known. See, for example, in Kirk-Othmer "Encyclopedia of Chemical Technology", Second Edition, Vol. 13, the article entitled "Nitrophenols", page 888 et seq., as well as the treatises "Aromatic Substitution; Nitration and Halogenation" by P. B. D. De La Mare and J. H. Ridd, N.Y., Academic Press, 1959; "Nitration and Aromatic Reactivity" by J. G. Hogget, London, Cambridge University Press, 1961; and "The Chemistry of the Nitro and Nitroso Groups", Henry Feuer, Editor, Interscience Publishers, N.Y., 1969.

Reduction of aromatic nitro compounds to the corresponding amines is also well known. See, for example, the article entitled "Amination by Reduction" in Kirk-Othmer "Encyclopedia of Chemical Technology", Second Edition, Vol. 2, pages 76-99. Generally, such reductions can be carried out with, for example, hydrogen, carbon monoxide or hydrazine, (or mixtures of same) in the presence of metallic catalysts such as palladium, platinum and its oxides, nickel, copper chromate, etc. Co-catalysts such as alkali or alkaline earth metal hydroxides or amines (including aminophenols) can be used in these catalyzed reductions.

Nitro groups can also be reduced in the Zinin reaction, which is discussed in "Organic Reactions", Vol. 20, John Wiley & Sons, N.Y., 1973, page 455 et seq. Generally, the Zinin reaction involves reduction of a nitro group with divalent negative sulfur compounds, such as alkali metal sulfides, polysulfides and hydrosulfides.

The nitro groups can be reduced by electrolytic action; see, for example, the "Amination by Reduction" article, referred to above.

Typically the aminophenols used in this invention are obtained by reduction of nitrophenols with hydrogen in the presence of a metallic catalyst such as discussed above. This reduction is generally carried out at temperatures of about 15°-250° C., typically, about 50°-150° C., and hydrogen pressures of about 0-2000 psig, typically, about 50-250 psig. The reaction time for reduction usually varies between about 0.5-50 hours. substantially inert liquid diluents and solvents, such as ethanol, cyclohexane, etc., can be used to facilitate the reaction. The aminophenol product is obtained by well known techniques such as distillation, filtration, extraction, and so forth.

The reduction is carried out until at least about 50%, usually about 80%, of the nitro groups present in the nitro intermediate mixture are converted to amino groups. The typical route to the aminophenols of this invention just described can be summarized as (1) nitrating with at least one nitrating agent at least one compound of the formula: $(R)_a$—Ar—(OH), wherein a, c, R and Ar are as defined above and Ar has 0 to 3 optional substituents (R') as defined above and (2) reducing at least about 50% of the nitro groups in said first reaction mixture to amino groups.

(A-2) Reaction Products of a Nitrophenol and an Aminophenol Compound

In another embodiment, the compositions of the present invention include the reaction product of a nitrophenol and an amino compound. The nitrophenol may be represented by the following formula:

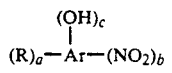

wherein a, b, c, R and Ar are as defined above. In a preferred embodiment the nitrophenols used in this invention contain a single aromatic ring, most preferably a benzene ring. This preferred class of nitrophenols can be represented by the formula:

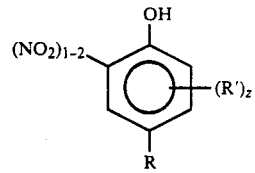

wherein R, R' and z and are as defined above.

The nitrophenols used in this invention can be prepared by a number of known synthetic routes. Various routes for preparing nitrophenols are discussed above.

The nitrophenols of the present invention are reacted with an amino compound. The amino compound may be a mono- or polyamine, including hydroxy monoamines, hydroxy polyamines, amine condensates, alkoxylated alkaline polyamines, heterocyclic polyamines, and nitrogen-containing dispersants.

The monoamines generally contain from 1 to about 24 carbon atoms, preferably 1 to about 12, and more preferably 1 to about 6. Examples of monoamines useful in the present invention include methylamine, ethylamine, propylamine, butylanine, octylamine, and dodecylanine. Examples of secondary amines include dimethylamine, diethylamine, dipropylamine, dibutylamine, methylbutylamine, ethylhexylamine, etc. Tertiary amines include trimethylamine, tributylamine, methyldiethylamine, ethyldibutylamine, etc.

In another embodiment, the amino compound may be a hydroxyamine. Typically, the hydroxyamines are primary, secondary or tertiary alkanol amines or mixtures thereof. Such amines can be represented by the formulae:

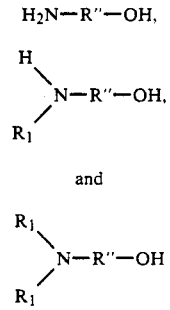

wherein each $R_1$ is independently a hydrocarbyl group of one to about eight carbon atoms or hydroxyhydrocarbyl group of two to about eight carbon atoms, preferably one to about four, and R'' is a divalent hydrocarbyl group of about two to about 18 carbon atoms, preferably two to about four. The group —R''—OH in such formulae represents the hydroxyhydrocarbyl group. R'' can be an acyclic, alicyclic or aromatic group. Typically, R'' is an acyclic straight or branched alkylene group such as an ethylene, 1,2-propylene, 1,2-butylene, 1,2-octadecylene, etc. group. Where two $R_1$ groups are present in the same molecule they can be joined by a direct carbon-to-carbon bond or through a heteroatom (e.g., oxygen, nitrogen or sulfur) to form a 5-, 6-, 7- or 8-membered ring structure. Examples of such heterocyclic amines include N-(hydroxyl lower alkyl)-morpholines, -thiomorpholines, -piperidines, -oxazolidines, -thiazolidines and the like. Typically, however, each $R_1$ is independently a methyl, ethyl, propyl, butyl, pentyl or hexyl group. Examples of alkanolamines include mono-, di-, and triethanol amine, diethylethanolamine, ethylethanolamine, butyldiethanolamine, etc.

The hydroxyamines can also be an ether N-(hydroxyhydrocarbyl) amine. These are hydroxypoly (hydrocarbyloxy) analogs of the above-described hydroxy amines (these analogs also include hydroxyl-substituted oxyalkylene analogs). Such N-(hydroxyhydrocarbyl) amines can be conveniently prepared by reaction of epoxides with aforedescribed amines and can be represented by the formulae:

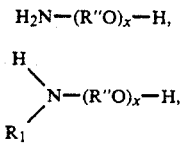

and

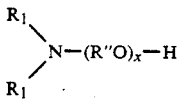

wherein x is a number from about 2 to about 15 and $R_1$ and R'' as described above. $R_1$ may also be a hydroxypoly(hydrocarbyloxy) group.

The amino compound may also be an ammonium cation derived from a polyamine. The polyamine may be aliphatic, cycloaliphatic, heterocyclic or aromatic. Examples of the polyamines include alkylene polyamines, hydroxy containing polyamines, arylpolyamines, and heterocyclic polyamines.

Alkylene polyamines are represented by the formula

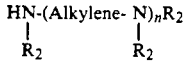

wherein n has an average value between about 1 and about 10, preferably about 2 to about 7, more preferably about 2 to about 5, and the "Alkylene" group has from 1 to about 10 carbon atoms, preferably about 2 to about 6, more preferably about 2 to about 4. $R_2$ is independently preferably hydrogen; or an aliphatic or hydroxy-substituted aliphatic group of up to about 30 carbon atoms. Preferably $R_2$ is defined the same as $R_1$.

Such alkylene polyamines include methylene polyamines, ethylene polyamines, butylene polyamines, propylene polyamines, pentylene polyamines, etc. The higher homologs and related heterocyclic amines such as piperazines and N-aminoalkyl-substituted piperazines are also included. Specific examples of such polyamines are ethylene diamine, triethylene- tetramine, tris-(2-aminoethyl)amine, propylene diamine, trimethylene diamine, tripropylene tetramine, tetraethylene pentamine, hexaethylene heptamine, pentaethylenehexamine, etc.

Higher homologs obtained by condensing two or more of the above-noted alkylene amines are similarly useful as are mixtures of two or more of the aforedescribed polyamines.

Ethylene polyamines, such as some of those mentioned above, are useful. Such polyamines are described in detail under the heading Ethylene Amines in Kirk Othmer's "Encyclopedia of Chemical Technology", 2d Edition, Vol. 7, pages 22–37, Interscience Publishers, New York (1965). Such polyamines are most conveniently prepared by the reaction of ethylene dichloride with ammonia or by reaction of an ethylene imine with a ring opening reagent such as water, ammonia, etc. These reactions result in the production of a complex mixture of polyalkylene polyamines including cyclic condensation products such as the aforedescribed piperazines. Ethylene polyamine mixtures are useful.

Other useful types of polyamine mixtures are those resulting from stripping of the above-described polyamine mixtures to leave as residue what is often termed "polyamine bottoms". In general, alkylene polyamine bottoms can be characterized as having less than two, usually less than 1% (by weight) material boiling below about 200° C. A typical sample of such ethylene polyamine bottoms obtained from the Dow Chemical Company of Freeport, Tex. designated "E-100" has a specific gravity at 15.6° C. of 1.0168, a percent nitrogen by weight of 33.15 and a viscosity at 40° C. of 121 centistokes. Gas chromatography analysis of such a sample contains about 0.93% "Light Ends" (most probably DETA), 0.72% TETA, 21.74% tetraethylene pentaamine and 76.61% pentaethylene hexamine and higher (by weight). These alkylene polyamine bottoms include cyclic condensation products such as piperazine and higher analogs of diethylenetriamine, triethylenetetramine and the like.

These alkylene polyamine bottoms can be reacted solely with the nitrophenol or they can be used with other amines, polyamines, or mixtures thereof.

Another useful polyamine is a condensation reaction between at least one hydroxy compound with at least one polyamine reactant containing at least one primary or secondary amino group. The hydroxy compounds are preferably polyhydric alcohols and amines. The polyhydric alcohols are described below. Preferably the hydroxy compounds are polyhydric amines. Polyhydric amines include any of the above-described monoamines reacted with an alkylene oxide (e.g., ethylene oxide, propylene oxide, butylene oxide, etc.) having two to about 20 carbon atoms, preferably two to about four. Examples of polyhydric amines include tri- (hydroxypropyl) amine, tris- (hydroxymethyl) amino methane, 2-amino-2-methyl-1,3-propanediol, N,N,N',N'-tetrakis(2-hydroxypropyl)ethylenediamine, and N,N,N',N'-tetrakis(2-hydroxyethyl)ethylenediamine, preferably tris(hydroxymethyl)aminomethane (THAM).

Polyamine reactants, which react with the polyhydric alcohol or amine to form the condensation products or condensed amines, are described above. Preferred polyamine reactants include triethylenetetramine (TETA), tetraethylenepentamine (TEPA), pentaethylenehexamine (PEHA), and mixtures of polyamines such as the above-described "amine bottoms".

The condensation reaction of the polyamine reactant with the hydroxy compound is conducted at an elevated temperature, usually about 60° C. to about 265° C., (preferably about 220° C. to about 250° C.) in the presence of an acid catalyst.

The amine condensates and methods of making the same are described in PCT publication W086/05501 which is incorporated by reference for its disclosure to the condensates and methods of making the same. The preparation of such polyamine condensates may occur as follows: A 4-necked 3-liter round-bottomed flask equipped with glass stirrer, thermowell, subsurface $N_2$ inlet, Dean-Stark trap, and Friedrich condenser is charged with: 1299 grams of HPA Taft Amines (amine bottoms available commercially from Union Carbide Co. with typically 34.1% by weight nitrogen and a nitrogen distribution of 12.3% by weight primary amine, 14.4% by weight secondary amine and 7.4% by weight tertiary amine), and 727 grams of 40% aqueous tris (hydroxymethyl) aminomethane (THAM). This mixture is heated to 60° C. and 23 grams of 85% $H_3PO_4$ is added. The mixture is then heated to 120° C. over 0.6 hour. With $N_2$ sweeping, the mixture is then heated to 150° C. over 1.25 hour, then to 235° C. over 1 hour more, then held at 230°-235° C. for 5 hours, then heated to 240° C. over 0.75 hour, and then held at 240°-245° C. for 5 hours. The product is cooled to 150° C. and filtered with a diatomaceous earth filter aid. Yield: 84% (1221 grams).

In another embodiment, the amino compounds are hydroxy-containing polyamines. Hydroxy-containing polyamine analogs of hydroxy monoamines, particularly alkoxylated alkylenepolyamines (e.g., N,N(diethanol)ethylene dismine) can also be used. Such polyamines can be made by reacting the above-described alkylene amines with one or more of the above-described alkylene oxides. similar alkylene oxide-alkanol amine reaction products can also be used such as the products made by reacting the aforedescribed primary, secondary or tertiary alkanol amines with ethylene, propylene or higher epoxides in a 1.1 to 1.2 molar ratio. Reactant ratios and temperatures for carrying out such reactions are known to those skilled in the art.

Specific examples of alkoxylated alkylenepolyamines include N-(2-hydroxyethyl) ethylenediamine, N,N-bis(2-hydroxyethyl)-ethylene-diamine, 1-(2-hydroxyethyl)piperazine, mono(hydroxypropyl)-substituted tetraethylenepentamine, N-(3-hydroxybutyl)-tetramethylene diamine, etc. Higher horaologs obtained by condensation of the aboveillustrated hydroxy-containing polyamines through amino groups or through hydroxy groups are likewise useful. Condensation through amino groups results in a higher amine accompanied by removal of ammonia while condensation through the hydroxy groups results in products containing ether linkages accompanied by removal of water. Mixtures of two or more of any of the aforesaid polyamines are also useful.

In another embodiment, the amino compound may be a cation derived from heterocyclic polyamine. The heterocyclic polyamines include aziridines, azetidines, azolidines, tetra- and dihydropyridines, pyrroles, indoles, piperidines, imidazoles, di- and tetrahydroizidazoles, piperazines, isoindoles, purines, morpholines, thiomorpholines, N-aminoalkylaorpholines, N-aminoalkylthiomorpholines, N-aminoalkylpiperazines, N,N'-diaminoalkylpiperazines, azepines, azocines, azonines, azecines and tetra-, di- and perhydro derivatives of each of the above and mixtures of two or more of these heterocyclic amines. Preferred heterocyclic amines are the saturated 5- and 6-membered heterocyclic amines containing only nitrogen, oxygen and/or sulfur in the hetero ring, especially the piperidines, piperazines, thiomorpholines, morpholines, pyrrolidines, and the like. Piperidine, aminoalkylsubstituted piperidines, piperazine, aminoalkylsubstituted piperazines, morpholine; aminoalkylsubstituted morpholines, pyrrolidine, and aminoalkyl-substituted pyrrolidines, are especially preferred. Usually the aminoalkyl substituents are substituted on a nitrogen atom forming part of the hetero ring. Specific examples of such heterocyclic amines include N-aminopropylmorpholine, N-aminoethylpiperazine, and N,N'-diaminoethylpiperazine. Hydroxy heterocyclic polyamines are also useful. Examples include N-(2-hydroxyethyl)cyclohexylamine, 3-hydroxycyclopentylamine, parahydroxyaniline, N-hydroxyethylpiperazine, and the like.

In another embodiment, the amino compound may be a dispersant. The dispersants include: nitrogen-containing carboxylic dispersants; amine dispersants; nitrogen-containing ester dispersants; and Mannich dispersants. The dispersants are discussed below.

To make the reaction product of a nitrophenol and an amino compound, at least one nitrophenol is condensed with at least one of the above-described amino compounds. The reaction is a condensation reaction which is continued until the reaction product is substantially free of nitro groups. The reaction is generally carried out at a temperature of 25° C. up to the decomposition temperature of the reaction mixture of the individual components. Generally, this temperature is below 250° C., preferably between 50°-175° C.

When the nitrophenol contains less than about 15 carbon atoms per nitro group per molecule it is desirable to conduct the initial part of the condensation at a lower temperature (e.g., 0° C. to 50° C.) and with care since violent reaction is possible. Generally, at least half of an equivalent of nitrophenol is used for each equivalent of amino compound. Usually it is not advantageous to use more than three equivalents of nitro compound per equivalent of amino compound or eight equivalents of amino compound per equivalent of nitrophenol.

In a typical embodiment, the total amounts of nitrophenol and amino compound employed in the condensation are in a ratio of about 0.5-10 equivalents of amino compound per mole of nitrophenol, preferably about 1.0-5.

(A-3) Nitrogen-containing Carboxylic Dispersants

The nitrogen-containing carboxylic dispersants include reaction products of hydrocarbyl-substituted carboxylic acylating agents such as substituted carboxylic acids or derivatives thereof . The amines are described above, typically the amines are polyamines, preferably the amines are ethylene amines, amine bottoms or amine condensates. The hydrocarbyl-substituted carboxylic acylating agent and polyamine are reacted at a temperature from about 0° C., preferably about 50° C., up to about 200° C., preferably up to about 150° C. Usually an equivalent of acylating agent is reacted with 1-4 equivalents of polyamine, preferably 2-4 equivalents.

The hydrogen-substituted carboxylic acylating agent may be derived from a monocarboxylic acid or a polycarboxylic acid. Polycarboxylic acids generally are preferred. The acylating agents may be a carboxylic acid or derivatives of the carboxylic acid such as the halides, esters, anhydrides, etc., preferably acid, esters or anhydrides, more preferably anhydrides. Preferably the carboxylic acylating agent is a succinic acylating agent.

The hydrocarbyl-substituted carboxylic acylating agent includes agents which have a hydrocarbyl group derived from a polyalkene. The polyalkene is characterized as containing from at least about 8 carbon atoms, preferably at least about 30, more preferably at least about 35 up to about 300 carbon atoms, preferably 200, more preferably 100. In one embodiment, the polyalkene is characterized by an Mn (number average molecular weight) value of at least about 500. Generally, the polyalkene is characterized by an Mn value of about 500 to about 5000, preferably about 800 to about 2500. In another embodiment Mn varies between about 500 to about 1200 or 1300.

In another embodiment, the hydrocarbyl groups are derived from polyalkenes having an Mn value of at least about 1300 up to about 5000, and the Mw/Mn value is from about 1.5 to about 4, preferably from about 1.8 to about 3.6, more preferably about 2.5 to about 3.2. The preparation and use of substituted succinic acylating agents wherein the substituent is derived from such polyolefins are described in U.S. Pat. No. 4,234,435, the disclosure of which is hereby incorporated by reference.

The polyalkenes include homopolymers and interpolymers of polymerizable olefin monomers of 2 to about 16 carbon atoms; usually 2 to about 6, preferably 2 to about 4, more preferably 4. The olefins may be monoolefins such as ethylene, propylene, 1-butene, isobutene, and 1-octene; or a polyolefinic monomer, preferably diolefinic monomer, such 1,3-butadiene and isoprene. Preferably, the interpolymer is a homopolymer. An example of a preferred homopolymer is a polybutene, preferably a polybutene in which about 50% of the polymer is derived from isobutylene. The polyalkenes are prepared by conventional procedures.

The hydrocarbyl-substituted carboxylic acylating agents are prepared by a reaction of one or more polyalkenes with one or more unsaturated carboxylic reagent. The unsaturated carboxylic reagent generally contains an alpha-beta olefinic unsaturation. The carboxylic reagents may be carboxylic acids per se and functional derivatives thereof, such as anhydrides, esters, amides, imides, salts, acyl halides, and nitriles. These carboxylic acid reagents may be either monobasic or polybasic in nature. When they are polybasic they are preferably dicarboxylic acids, although tri- and tetracarboxylic acids can be used. Specific examples of useful monobasic unsaturated carboxylic acids are acrylic acid, methacrylic acid, cinnamic acid, crotonic acid, 2-phenylpropenoic acid, etc. Exemplary polybasic acids include maleic acid, fumaric acid, mesaconic acid, itaconic acid and citraconic acid. Generally, the unsaturated carboxylic acid or derivative is maleic anhydride or maleic or fumaric acid or ester, preferably, maleic acid or anhydride, more preferably maleic anhydride.

The polyalkene may be reacted with the carboxylic reagent such that there is at least one mole of reagent for each mole of polyalkene. Preferably, an excess of reagent is used. This excess is generally between about 5% to about 25%.

In another embodiment, the acylating agents are prepared by reacting the above described polyalkene with an excess of maleic anhydride to provide substituted succinic acylating agents wherein the number of succinic groups for each equivalent weight of substituent group is at least 1.3. The maximum number will not exceed 4.5. A suitable range is from about 1.4 to 3.5 and more specifically from about 1.4 to about 2.5 succinic groups per equivalent weight of substituent groups. In this embodiment, the polyalkene preferably has an Mn from about 1300 to about 5000 and a Mw/Mn of at least 1.5, as described above, the value of Mn is preferably between about 1300 and 5000. A more preferred range for Mn is from about 1500 to about 2800, and a most preferred range of Mn values is from about 1500 to about 2400.

The conditions, i.e., temperature, agitation, solvents, and the like, for reacting an acid reactant with a polyalkene, are known to those in the art. Examples of patents describing various procedures for preparing useful acylating agents include U.S. Pat. Nos. 3,215,707 (Rense) 3,219,666 (Norman et al) ; 3,231,587 (Rense) ; 3,912,764 (Palmer) ; 4,110,349 (Cohen) ; and 4,234,435 (Meinhardt et al); and U.K. 1,440,219. The disclosures of these patents are hereby incorporated by reference.

(A-4) Amine Dispersants

The dispersant may also be an amine dispersant. Amine dispersants are hydrocarbyl-substituted amines. These hydrocarbyl-substituted amines are well known to those skilled in the art. These amines are disclosed in U.S. Pat. Nos. 3,275,554; 3,438,757; 31454,555; 3,565,804; 3,755,433; and 3,822,289. These patents are hereby incorporated by Reference for their disclosure of hydrocarbyl amines and methods of making the same.

Typically, amine dispersants are prepared by reacting olefins and olefin polymers (polyalkenes) with amines (mono- or polyamines) . The polyalkene may be any of the polyalkenes described above. The amines may be any of the amines described above. Examples of amine dispersants include poly(propylene)amine; N,N-dimethyl-N-poly(ethylene/propylene)amine, (50:50 mole ratio of monomers); polybutene amine; N, N-di (hydroxyethyl) -N-polybutene amine; N-(2-hydroxypropyl) -N-polybutene amine; N-polybutene-aniline; N-polybutenemorpholine; N-poly(butene)ethylenediamine; N-poly (propylene) trimethylenediamine; N-poly (butene) diethylenetriamine;N',N'-poly(butene)tetraethylenepentamine;N, N-dimethyl-N'-poly(propylene)-1,3-propylenediamine and the like.

(A-5) Ester Dispersants

In another embodiment, the dispersant may also be an ester dispersant. The ester dispersant is prepared by reacting at least one of the above hydrocarbyl-substituted carboxylic acylating agents with at least one organic hydroxy compound and optionally an amine. In another embodiment, the ester dispersant is prepared by reacting the acylating agent with the above-described hydroxy amine.

The organic hydroxy compound includes compounds of the general formula $R^4(OH)_m$ wherein $R^4$ is a monovalent or polyvalent organic group joined to the —OH groups through a carbon bond, and m is an integer of from 1 to about 10 wherein the hydrocarbyl group contains at least about 8 aliphatic carbon atoms. The hydroxy compounds may be aliphatic compounds such as monohydric and polyhydric alcohols, or aromatic compounds such as phenols and naphthols. The aromatic hydroxy compounds from which the esters may be derived are illustrated by the following specific examples: phenol, beta-naphthol, alpha-naphthol, cresol, resorcinol, catechol, p,p'-dihydroxybiphenyl, 2-chlorophenol, 2,4-dibutylphenol, etc.

The alcohols from which the esters may be derived preferably contain up to about 40 aliphatic carbon atoms, preferably from 2 to about 30, more preferably 2 to about 10. They may be monohydric alcohols such as reethanol, ethanol, isooctanol, dodecanol, cyclohexanol, etc. In one embodiment, the hydroxy compounds are polyhydric alcohols, such as alkylene polyols. Preferably, the polyhydric alcohols contain from 2 to about 40 carbon atoms, more preferably 2 to about 20; and from 2 to about 10 hydroxyl groups, more preferably 2 to about 6. Polyhydric alcohols include ethylene glycols, including di-, tri- and tetraethylene glycols; propylene glycols, including di-, triand tetrapropylene glycols; glycerol; butane diol; hexane diol; sorbitol; arabitol; mannitol; sucrose; fructose; glucose; cyclohexane diol; erythritol; and pentaerythritols, including di- and tripentaerythritol; preferably, diethylene glycol, triethylene glycol, glycerol, sorbitol, pentaerythritol and dipentaerythritol.

The polyhydric alcohols may be esterified with monocarboxylic acids having from 2 to about 30 carbon atoms, preferably about 8 to about 18, provided that at least one hydroxyl group remains unesterified. Examples of monocarboxylic acids include acetic, propionic, butyric and fatty carboxylic acids. The fatty monocarboxylic acids have from about 8 to about 30 carbon atoms and include octanoic, oleic, stearic, linoleic, dodecanoic and tall oil acid. Specific examples of these esterified polyhydric alcohols include sorbitol oleate, including mono- and dioleate, sorbitol stearate, including mono- and distearate, glycerol oleate, including glycerol mono-, di- and trioleate and erythritol octanoate.

The carboxylic ester dispersants may be prepared by any of several known methods. The method which is preferred because of convenience and the superior properties of the esters it produces, involves the reaction of a the carboxylic acylating agents described above with one or more alcohols or phenols in ratios of from about 0.5 equivalent to about 4 equivalents of hydroxy compound per equivalent of acylating agent. The esterification is usually carried out at a temperature above about 100° C., preferably between 150° C. and 300° C. The water formed as a by-product is removed by distillation as the esterification proceeds. The preparation of useful carboxylic ester dispersant is described in U.S. Pat. Nos. 3,522,179 and 4,234,435.

The carboxylic ester dispersants may be further reacted with at least one of the above described amines and preferably at least one of the above described polyamines. In one embodiment, the amount of amine which is reacted is an amount sufficient to neutralize any unesterified carboxylic acid groups. In one preferred embodiment, the nitrogen-containing carboxylic ester dispersants are prepared by reacting about 1.0 to 2.0 equivalents, preferably about 1.0 to 1.8 equivalents of hydroxy compounds, and up to about 0.3 equivalent, preferably about 0.02 to about 0.25 equivalent of polyamine per equivalent of acylating agent.

In another embodiment, the carboxylic acid acylating agent may be reacted simultaneously with both the alcohol and the amine. There is generally at least about 0.01 equivalent of the alcohol and at least 0.01 equivalent of the amine although the total amount of equivalents of the combination should be at least about 0.5 equivalent per equivalent of acylating agent. These nitrogen-containing carboxylic ester dispersant compositions are known in the art, and the preparation of a number of these derivatives is described in, for example, U.S. Pat. Nos. 3,957,854 and 4,234,435 which have been incorporated by reference previously.

The carboxylic ester dispersants and methods of making the same are known in the art and are disclosed in U.S. Pat. Nos. 3,219,666, 3,381,022, 3,522,179 and 4,234,435 which are hereby incorporated by reference for their disclosures of the preparation of carboxylic ester dispersants.

(A-6) Mannich Dispersants

The dispersant may also be a Mannich dispersant. Mannich dispersants are formed by the reaction of at least one aldehyde, at least one of the above described amine and at least one hydroxyaromatic compound. The reaction may occur from room temperature to 225° C., usually from 50° to about 200° C. (75°-125° C. most preferred), with the amounts of the reagents being such that the molar ratio of hydroxy-aromatic compound to formaldehyde to amine is in the range from about (1:1:1) to about (1:3:3).

The first reagent is a hydroxyaromatic compound. This term includes phenols (which are preferred), carbon-, oxygen-, sulfur- and nitrogen-bridged phenols and the like as well as phenols directly linked through covalent bonds (e.g. 4,4'-bis (hydroxy) biphenyl), hydroxy compounds derived from fused-ring hydrocarbon (e. g. , naphthols and the like); and polyhydroxy compounds such as catechol, resorcinol and hydroquinone. Mixtures of one or more hydroxyaromatic compounds can be used as the first reagent.

The hydroxyaromatic compounds are those substituted with at least one, and preferably not more than two, aliphatic or alicyclic groups having at least about 6 (usually at least about 30, more preferably at least 50) carbon atoms and up to about 400 carbon atoms, preferably 300, more preferably 200. These groups may be derived from the above described polyalkenes. In one embodiment, the hydroxyaromatic compound is a phenol substituted with an aliphatic or alicyclic hydrocarbon-based group having an Mn of about 420 to about 10,000.

The second reagent is a hydrocarbon-based aldehyde, preferably a lower aliphatic aldehyde. Suitable aldehydes include formaldehyde, benzaldehyde, acetaldehyde, the butyraldehydes, hydroxybutyraldehydes and heptanals, as well as aldehyde precursors which react as aldehydes under the conditions of the reaction such as paraformaldehyde, paraldehyde, formalin and methal. Formaldehyde and its precursors (e.g., paraformaldehyde, trioxane) are preferred. Mixtures of aldehydes may be used as the second reagent.

The third reagent is any amine described above. Preferably the amine is a polyamine as described above.

Mannnich dispersants are described in the following patents: U.S. Pat. No. 3,980,569; U.S. Pat. No. 3,877,899; and U.S. Pat. No. 4,454,059 (herein incorporated by reference for their disclosure to Mannich dispersants).

The following specific illustrative examples describe the preparation of dispersants useful in the present invention. In the following examples, as well as elsewhere in the specification and claims, parts are parts by weight, temperature is degrees Celsius and pressure is atmospheric, unless otherwise clearly indicated.

EXAMPLE A-1

A mixture of 4578 parts of a polyisobutene-substituted phenol prepared by boron trifluoride-phenol catalyzed alkylation of phenol with a polyisobutene having a number average molecular weight of approximately 1000 (vapor phase osmometry), 3052 parts of 100 neutral mineral oil and 725 parts of textile spirits is heated to 60° to achieve homogenity. After cooling to 30°, 319.5 parts of 16 molar nitric acid in 600 parts of water is added to the mixture. Cooling is necessary to keep the mixture's temperature below 40°. After the reaction mixture is stirred for an additional two hours, an aliquot of 3710 parts is transferred to a second reaction vessel. This second portion is treated with an additional 127.8 parts of 16 molar nitric acid in 130 parts of water at 25°-30°. The reaction mixture is stirred for 1.5 hours and then stripped to 220°/30 torr. Filtration provides an oil solution of the desired intermediate.

A mixture of 810 parts of the oil solution of the above prepared intermediate, 405 parts of isopropyl alcohol and 405 parts of toluene is charged to an appropriately sized autoclave. Platinum oxide catalyst (0.81 part) is added and the autoclave is evacuated and purged with nitrogen four times to remove any residual air. Hydrogen is fed to the autoclave at a pressure of 29-55 psig. while the content is stirred and heated to 27°-92° for a total of 13 hours. Residual excess hydrogen is removed from the reaction mixture by evacuation and purging with nitrogen four times. The reaction mixture is then filtered through diatomaceous earth and the filtrate stripped to provide an oil solution of the desired aminophenol. This solution contains 0.58% nitrogen.

EXAMPLE A-2

To a mixture of 361.2 parts of a deca(propylene)-substituted phenol and 270.9 parts of glacial acetic acid, at 7°-17°, is added a mixture of 90.3 parts of nitric acid (70-71% $HNO_3$) and 90.3 parts of glacial acetic acid. The addition is carried out over 1.5 hours while the reaction mixture is cooled externally to keep it at 7°-17°. The cooling bath is removed and the reaction stirred for two hours at room temperature. The reaction is then stripped at 134°/35 torr and filtered to provide the desired nitrated intermediate as a filtrate having a nitrogen content of 4.654%.

A mixture of 150 parts of the above intermediate and 50 parts of ethanol is added to an autoclave. This mixture is degassed by purging with nitrogen, and 0.75 part of palladium on charcoal catalyst is added. The autoclave is evacuated and pressured with nitrogen several times and then put under a hydrogen pressure of 100 psig. The reaction mixture is kept it 95° to 100° for 2.5 hours while the hydrogen pressure varies from 100 to 20 psig. As the hydrogen pressure drops below 30 psig., it is adjusted back to 100 psig. The reaction is continued for 20.5 hours at which point the autoclave is reopened and an additional 0.5 part of palladium on charcoal catalyst added. After repeated nitrogen purging (3 times) the autoclave is again pressured to 100 psig. with hydrogen and the reaction continued for an additional 16.5 hours. A total of 2.0 moles of hydrogen is fed to the autoclave. The reaction mixture is filtered and stripped to 130°/16 torr. A second filtration provides the aminophenol product as a filtrate which is predominantly a monoamine product having the amino group ortho to the hydroxyl group and the deca(propylene) substituent para to the hydroxyl group.

EXAMPLE A-3

To a mixture of 3685 parts of a polybutene-substituted phenol (wherein the polybutene substituent contains 40 to 45 carbon atoms) and 1400 parts of textile spirits is added 790 parts of nitric acid (70%). The reaction temperature is kept below 50°. After being stirred for about 0.7 hour, the reaction mixture is poured into 5000 parts of ice and stored for 16 hours. The organic layer which separates is washed twice with water and then combined with 1000 parts of benzene. This solution is stripped to 170°, and the residue filtered to provide the desired intermediate as a filtrate.

A mixture of 130 parts of the above intermediate, 130 parts of ethanol, and 0.2 part of platinum oxide (86.4% $PtO_2$) is charged to a hydrogenation bomb. The bomb is purged several times with hydrogen and then charged to 54 psig. with hydrogen. The bomb is rocked for 24 hours and again charged to 70 psig. with hydrogen. Rocking is continued for an additional 98 hours. Stripping of the resulting reaction mixture to 145°/760 torr provides the desired aminophenol product as a semi-solid residue.

EXAMPLE A

A mixture of 105 parts of the intermediate of Example 3, 303 parts cyclohexane and 4 parts commercial Raney nickel catalyst is charged to an appropriately sized hydrogenation bomb. The bomb is pressured to 1000 psig. with hydrogen and agitated at about 50° for 16 hours. The bomb is again pressured to 1100 psig. and agitated for another 24 hours. The bomb is then opened and the reaction mixture filtered and recharged to the bomb with a fresh portion of 4 parts of Raney nickel catalyst. The bomb is pressured to 1100 psig. and agitated for 24 hours. The resultant reaction mixture is stripped to 95°/28 torr to provide the aminophenol product as a semi-solid residue.

EXAMPLE A-5

To a mixture of 400 parts of polybutene-substituted phenol (wherein the polybutene substituent contains approximately 100 carbon atoms), 125 parts of textile spirits and 266 parts of a diluent mineral oil at 28° is slowly added 22.8 parts of nitric acid (70%) in 50 parts of water over a period of 0.33 hour. The mixture is stirred at 28°-34° for two hours and stripped to 158°/30 torr, filtration provides an oil solution (40%) of the desired nitrophenol intermediate having a nitrogen content of 0.884%.

A mixture of 93 parts of the above intermediate and 93 parts of a mixture of toluene and isopropanol (50/50 by weight) is charged to an appropriately sized hydrogenation vessel. The mixture is degassed and nitrogen purged; 0.31 part of a commercial platinum oxide catalyst (86.4% $PtO_2$) is added. The reaction vessel is pressured to 57 psig and held at 50°-60° for 21 hours. A total of 0.6 mole of hydrogen is f ed to the reaction vessel. The reaction mixture is then filtered and the filtrate stripped to yield the desired aminophenol product as an oil solution containing 0.444 nitrogen.

EXAMPLE A-6

A reaction vessel is charged with 750 parts of 100 neutral diluent oil and 1000 parts of a polybutenylsubstituted phenol derived from a polybutene (number average molecular weight equals 940). The mixture is heated to 45°-65° C. and 89.5 parts of a 62% solution of nitric acid is added to the reaction mixture. The reaction temperature increases exothermically. The reaction temperature is maintained at 60°-65° C. for two hours. The reaction mixture is heated to 155°-165°0 C. under nitrogen. Hydrazine hydrate (71 parts) is added to the reaction mixture over 6.5 hours. The reaction is filtered through diatomaceous earth under nitrogen. The filtrate is the desired product and has a TBN of 23, 0.55% nitrogen, and 40% 100 neutral mineral oil.

EXAMPLE A-7

An alkylated phenol is prepared by reacting phenol with a polybutene having a number average molecular weight of approximately 1000 (vpo) in the presence of a boron trifluoride-phenol complex catalyst. The product formed is vacuum stripped to 230° C. and 760 tor and then 205° C./50 tor to provide a polybutene-substituted phenol.

The polybutene-substituted phenol (4578 parts), 3052 parts of a 100 neutral mineral oil and 725 parts of textile spirits is heated with agitation to 60° C. After cooling to 30° C., a mixture of 319.5 parts of a 16-molar nitric acid and 600 parts is slowly added into the mixture which is kept below 40° C. by external cooling. After stirring the mixture for an additional 2 hours, 3710 parts is transferred to a second reaction vessel. The remaining material is stripped to 150° C./43 tor, cooled to 110° C. and filtered through diatomaceous earth to provide as a filtrate the desired nitrophenol. This material has a nitrogen content of 0.53%.

The above nitrophenol (1353 parts) is added to 61.5 parts of a commercial polyethylenepolyamine mixture containing 33.5% nitrogen and substantially corresponding in empirical formula to tetraethylenepentamine. The reaction mixture is heated to 80° C. for 1.5 hours and then stored for 16 hours at 25° C. It is then heated to 130°-160° C. for a total 15 hours and finally stripped to 160/30 tor. The residue is filtered through diatomaceous earth to give a product which contains 1.5% nitrogen.

EXAMPLE A-8

A mixture of 1600 parts of a polybutene-substituted phenol prepared as described in Example A-7 from polybutene having a number average molecular weight of 1400 (gel permeation chromatography), 10 parts of aqueous hydrochloric acid and 33 parts of paraformaldehyde is heated to 90° C. under nitrogen atmosphere for 20 hours with intermittent storage at room temperature. 500 parts of textile spirits are then added, followed by 91.3 parts of concentrated nitric acid and 100 parts water. During the nitric acid addition the reaction temperature is maintained at 130°-138° C. by external cooling. The reaction mixture is then stirred for two hours at room temperature and 61.5 parts of polyethylene polyamine described in Example A is added slowly. The reaction mixture is heated to 160° C. for seven hours and then stripped at 160° C. and 30 tor. The residue is filtered through diatomaceous earth to yield a product that has a nitrogen content of 0.88%.

EXAMPLE A-9

An oil solution (679 parts) of a nitropolybutene-substituted phenol made as described in Example A-7 and comprising 604 by weight of the oil solution is added to a reaction vessel containing 134 parts of triethanolamine. The addition is accomplished over 1.5 hours. The reaction mixture is held for 12 hours at 200° C. The mixture is stripped to 200° C./20 tor and cooled to 100° C. The reaction mixture is filtered through diatomaceous earth to provide a product containing 0.974 nitrogen.

EXAMPLE A-10

A mixture of 1500 parts of chlorinated poly(isobutene) (of molecular weight of about 950 and having a chlorine content of 5.6%), 285 parts of an alkylene polyamine having an average composition corresponding stoichiometrically to tetraethylene pentamine and 1200 parts of benzene is heated to reflux. The mixture's temperature is then slowly increased over a 4-hour period to 170° C. while benzene is removed. The cooled mixture is diluted with an equal volume of mixed hexanes and absolute ethanol (1:1). This mixture is heated to reflux and a ⅓ volume of 104 aqueous sodium carbonate is added to it. After stirring, the mixture is allowed to cool and the phases separate. The organic phase is washed with water and stripped to provide the desired polyisobutenyl polyamine having a nitrogen content of 4.5%.

EXAMPLE A-11

A mixture of 140 parts of toluene and 400 parts of a polyisobutenyl succinic anhydride (prepared from the poly(isobutene) having a molecular weight of about 850, vapor phase osmometry) having a saponification number 109, and 63.6 parts of an ethylene amine mixture having an average composition corresponding in stoichiometry to tetraethylene pentamine, is heated to 150° C. while the water/toluene azeotrope is removed. The reaction mixture is then heated to 150° C. under reduced pressure until toluene ceases to distill. The residual acylated polyamine has a nitrogen content of 4.7%.

EXAMPLE A-12

A reaction vessel is charged with 820 parts of 100 neutral mineral oil and 1000 parts of a polybutenylsubstituted succinic anhydride derived from a polybutene (number average molecular weight equal to 960). The mixture is heated to 110° C. whereupon 85.0 parts of an ethylene amine mixture having an average composition corresponding to the stoichiometry of tetraethylenepentamine is added to the reaction mixture. The reaction mixture is heated to 150°-160° C. and held for four hours. The reaction mixture is cooled and filtered through diatomaceous earth. The filtrate has a total base number of 35, 1.564 nitrogen and 404 100 neutral mineral oil.

EXAMPLE A

A reaction vessel is charged with 400 parts of 100 neutral mineral oil and 1000 parts of the polybutenyl succinic anhydride described in Example A-12. The mixture is heated to 88° C. where 152 parts of a condensed amine (prepared by reacting HPA Taft amines available from Union Carbide with tris(hydroxymethyl-)amino methane (THAM)) is added to the reaction mixture. The reaction temperature is increased to 152° C. and maintained for 5.5 hours. The reaction mixture is cooled to 145° C. and filtered through diatomaceous earth. The filtrate contains 40% 100 neutral mineral oil and 2.15% nitrogen.

EXAMPLE A-14

To a mixture of 50 parts of a polypropyl-substituted phenol (having a molecular weight of about 900, vapor phase osmometry), 500 parts of mineral oil (a solvent refined paraffinic oil having a viscosity of 100 SUS at 100° F.) and 130 parts of 9.5% aqueous dimethylamine solution (equivalent to 12 parts amine) is added dropwise, over an hour, 22 parts of a 374 aqueous solution of formaldehyde (corresponding to 8 parts aldehyde). During the addition, the reaction temperature is slowly increased to 100° C. and held at that point for three hours while the mixture is blown with nitrogen. To the cooled reaction mixture is added 100 parts toluene and 40 parts mixed butyl alcohols. The organic phase is washed three times with water until neutral to litmus paper and the organic phase filtered and stripped to 200° C./5-10 torr. The residue is an oil solution of the final product containing 0.5% nitrogen.

EXAMPLE A-15

A substantially hydrocarbon-substituted succinic anhydride is prepared by chlorinating a polyisobutene having a molecular weight of 1000 to a chlorine content of 4.5% and then heating the chlorinated polyisobutene with 1.2 molar proportions of maleic anhydride at a temperature of 150°-220° C. The succinic anhydride thus obtained has an acid number of 130. A mixture of 874 grams (1 mole) of the succinic anhydride and 104 grams (1 mole) of neopentyl glycol is mixed at 240°-250° C./30 mm. for 12 hours. The residue is a mixture of the asters resulting from the esterification of one and both hydroxy radicals of the glycol. It has a saponification number of 101 and an alcoholic hydroxyl content of 0.2%.

EXAMPLE A-16

An ester is prepared by heating 658 parts of a carboxylic acid having an average molecular weight of 1018 (prepared by reacting chlorinated polyisobutene with acrylic acid) with 22 parts of pentaerythritol while maintaining a temperature of about 180°-205° C. for about 18 hours during which time nitrogen is blown through the mixture. The mixture is then filtered and the filtrate is the desired ester.

(B) Fatty Acid-polyamine Reaction Product

The methods and compositions of the present invention also contain the reaction product of a fatty carboxylic acid of and at least one polyamine. The fatty carboxylic acids are generally mixtures of straight and branched chain fatty carboxylic acids containing about 8 to about 30 carbon atoms, preferably about 12 to about 24, more preferably about 16 to about 18. Carboxylic acids include the polycarboxylic acids or carboyxlic acids or anhydrides having from 2.. to about 4 carbonyl groups, preferably 2. The polycarboxylic acids include succinic acids and anhydrides and Diels-Alder reaction products of unsaturated monocarboxylic acids with unsaturated carboxylic acids (such as acrylic, methacrylic, maleic, funaric, crotonic and itaconic acids). Preferably, the fatty carboxylic acids are fatty monocarboxylic acids, having from about 8 to about 30, preferably about 12 to about 24 carbon atoms, such as octanoic, oleic, stearic, linoleic, dodecanoic, and tall oil acids, preferably stearic acid.

The fatty carboxylic acid is reacted with at least one polyamine. The polyamines may be aliphatic, cycloaliphatic, heterocyclic or aromatic. Examples of the polyamines include alkylene polyamines and heterocyclic polyamines.

A preferred reaction product of a carboxylic acid and polyamine is made by reacting the above-described alkylene polyamines with a mixture of fatty acids having from 5 to about 30 mol percent straight chain acid and about 70 to 954 mol branch chain fatty acids. Among the commercially available mixtures are those known widely in the trade as isostearic acid. These mixtures are produced as a by-product from the dimerization of unsaturated fatty acids as described in U.S. Pat. Nos. 2,812,342; and 3,260;671. These patents are hereby incorporated by reference for their disclosure of these reaction products and methods of making the same.

The branched chain fatty acids can also include those in which the branch is not alkyl in nature, such as found in phenyl and cyclohexyl stearic acid and the chlorostearic acids. Branched chain fatty carboxylic acid-/alkylene polyamine products have been described extensively in the art. See, for example,, U.S. Pat. Nos. 3,110,673; 3,251,853; 3,326,801; 3,337,459; 3,405,064; 3,429,674; 3,468,639; and 3,857,791. These patents are hereby incorporated by reference for their disclosures of fatty acid/ polyamine condensates for their use in lubricating oil formulations.

In another embodiment, the reaction product of a fatty carboxylic acid and a polyamine are further reacted with an epoxide. Epoxides are generally lower aliphatic epoxides, having from 1 to about 7 carbon atoms, preferably from 1 to about 5 carbon atoms, preferably 2 to about 4 carbon atoms. Examples of these epoxides include ethylene oxide, propylene oxide, butylene oxide, cyclohexene oxide and octylene oxide. The epoxides generally react in an amount from about 0. 5-% to about 5% by weight of lower epoxide based on the total weight of the reaction product. The reaction generally occurs at a temperature above about 100° C. The reaction product of a fatty acid, polyamine and epoxide is described in U.S. Pat. No. 3,240,575 which is hereby incorporated by reference for its teachings to carboxylic acids, polyamines, epoxides and reaction products and methods of making the reaction products.

The following examples illustrate the reaction product (B) of the present invention.

EXAMPLE B-2

To 1133 arts of commercial diethylene triamine heated at 110°-150° C. is slowly added 6820 parts of isostearic acid over a period of two hours. The mixture is held at 150° C. for one hour and then heated to 180° C. over an additional hour. Finally, the mixture is heated to 205° C. over 0.5 hour; through this beating, the mixture is blown with nitrogen to remove volatiles. The mixture is held at 205°-230° C. for a total of 11.5 hours and then stripped at 230° C./20 torr to provide the desired acylated polyamine as a residue containing 6.2% nitrogen.

EXAMPLE B-2

To 205 parts of commercial tetraethylene pentamine heated to about 75° C. there is added 1000 parts of isostearic acid while purging with nitrogen, and the temperature of the mixture is maintained at about 75°-110° C. The mixture then is heated to 220° C. and held at this temperature until the acid number of the mixture is less than 10. After cooling to about 150° C., the mixture is filtered, and the filtrate is the desired acylated polyamine having a nitrogen content of about 5.9%.

EXAMPLE B-3

A mixture (565 parts by weight) of an alkylene amine mixture consisting of triethylene tetramine and diethylene triamine in weight ratio of 3:1 is added at 200°-80° C. to a mixture of equivalent amounts of a naphthenic acid having an acid number of 180 (1270 parts) and oleic acid (1110 parts; the total quantity of the two acids used is such as to provide one equivalent for each two equivalents of the amine mixture used). The reaction is exothermic. The mixture is blown with nitrogen while it is being heated to 240° C. in 4.5 hours and thereafter heated at this temperature for 2 hours. Water is collected as the distillate. To the above residue ethylene oxide (140 parts) is added at 170°-180° C. within a period of 2 hours while nitrogen is bubbled through the reaction mixture. The reaction mixture is then blown with nitrogen for 15 minutes and diluted with 940 parts of xylene to a solution containing 25% of xylene. The resulting solution has a nitrogen content of 5.4% and a base number of 82 at pH of 4, the latter being indicative of free amino groups.

(C) Varnish Dissolvers

The methods and compositions of the present invention also contain (C) at least 25% by weight of at least one varnish dissolver selected from (a) keto-alcohols, (b) carboxylic esters having up to a total of 24 carbon atoms, and (c) alkoxy alcohols. In one embodiment the varnish dissolver (C) comprises at least two of (a), (b) and (c). In another embodiment, the varnish dissolver is a mixture of (a), (b) and (c).

(a) Keto Alcohols

The compositions of the present invention may also include a keto alcohol. A keto alcohol is characterized as having a keto group and hydroxyl group within its structure. Examples of keto alcohols include hydroxyacetone, diacetone alcohol, hydroxymethylpentanone or hydroxymethylbutanone.

(b) Carboxylic Esters

The composition of present invention may also include a carboxylic ester having up to a total of about 24 carbon atoms. Preferably, the carboxylic ester is prepared from carboxylic acids having from 2 to about 20 carbon atoms, more preferably 2 to about 12, more preferably 2 to about 8. Examples of carboxylic acids include acetic, propionic, butyric, hexanoic, octanoic, and dodecanoic acid, preferably acetic, propionic or butyric, more preferably acetic. The carboxylic acids are esterified with alcohols having from 1 to about 22 carbon atoms, preferably 1 to about 12, more preferably 1 to about 8. Examples of alcohols include methanol, ethanol, propanol, butanol, hexanol, cyclohexanol, dodecanol, preferably methanol, ethanol, propanol and butanol. Specific examples of carboxylic esters include methyl, ethyl, propyl and butyl acetates; ethyl, propyl, butyl and hexyl propionates; propyl and butyl butyrates; and methyl, propyl, butyl, octyl and octanoates, etc.

(c) Alkoxy Alcohols

The compositions may include alkoxy alcohols. These alkoxy alcohols are characterized as having ether linkages and may be prepared by using alkylene oxides, having from 2 to about 10 carbon atoms, (such as ethylene oxide, propylene oxide, butylene oxide and octene epoxide) . Examples of alkoxy alcohols include methoxyethyl, methoxypropyl, ethoxyethyl, ethoxypropyl, propoxyethyl, propoxypropyl, butoxyethyl and butoxypropyl alcohols.

Alkoxy alcohols having an ether linkage are available commercially from Union Carbide Corporation under the tradenames Cellosolve® solvents, Propasole® solvents and Ucon® fluids. Alkoxy alcohols having two ether linkages are available commercially from Union Carbide Corporation under the tradename Carbitol® solvents. Specific examples of these materials include Cellosolve® solvent (ethylene glycol monoethylether) ; methyl, propyl, butyl, and hexyl Cellosolve® solvent (ethylene glycol monomethyl, monopropyl, monobutyl and monohexyl ethers, respectively) ; Propasol® solvent (propylene glycol, monoethyl ether) ; methyl, propyl, butyl and hexyl Propasol® solvents (propylene glycol, monomethyl, monopropyl, monobutyl and monohexyl ethers, respectively); Carbitol® solvent (dipropylene glycol monoethyl ether) ; and methyl, propyl, butyl, and hexyl Carbitol® solvents (diethylene glycol monomethyl, monopropyl, monobutyl and monohexyl ether, respectively). Examples of Ucon® fluids include Ucon® LB-385, LB-625, LB-1145, LB-1715 and LB-3000 fluids (propoxylated butanols), Ucon® LO-500 (propoxylated oleoalcohol), and Ucon® 50-HB660, 50-HB-2000, 50-HB-2520, and 50-HB-5100 fluids (mixed ethoxylated and propoxylated butanol).

The alkoxy alcohol includes polyoxyalkylene polyols, including glycols. Examples of these alcohols include, polyoxyalkylene polyols, alkyl terminated polyoxyalkylene alcohols, hydroxy amines, polyoxyalkylated phenol, and polyoxyalkylene fatty esters.

The polyoxyalkylene polyols include polyoxyalkylene glycols. The polyoxyalkylene glycols may be polyoxyethylene glycols or polyoxypropylene glycols. Useful polyoxyethylene glycols are available from Union Carbide under the trade name Carbowax® PEG 300, 600, 1000 and 1450. The polyoxyalkylene glycols are preferrably polyoxypropylene glycols where the oxypropylene units are at least 80% of the total. The remaining 20% may be ethylene oxide or butylene oxide or other such esters, olefins and the like which may be polarized with polypropylene oxide. Useful polyoxypropylene glycols are available from Union Carbide under the trade name NIAX 425; and NIAX 1025. Useful polyoxypropylene glycols are available from Dow Chemical and sold by the trade name PPG-1200, and PPG-2000.

Representative of other useful polyoxyalkylene polyols are the liquid polyols available from Wyandotte Chemicals Company under the name PLURONIC Polyols and other similar polyols. These PLURONIC Polyols correspond to the formula $$HO-(CH_2CH_2O)_x(\underset{\substack{|\\ CH_3}}{CH}CH_2O)_y(CH_2CH_2O)_z-H$$

wherein x, y, and z are integers greater than 1 such that the $-CH_2CH_2O-$groups comprise from about 10% to about 15% by weight of the total number average molecular weight of the glycol, the number average molecular weight of said polyols being from about 2500 to about 4500. This type of polyol can be prepared by reacting propylene glycol with propylene oxide and then with ethylene oxide.

In another embodiment the alkoxy alcohol is an alkyl terminated polyoxyalkylene alcohol. The alkyl terminated polyoxyalkylene alcohol is an alkyl ether of a polyoxyalkylene polyol. A variety of alkyl terminated polyoxyalkylene alcohols are known in the art, and many are available commercially. The alkyl terminated polyoxyalkylene alcohols are produced generally by treating an aliphatic alcohol with an excess of an alkylene oxide such as ethylene oxide or propylene oxide. For example, from about 6 to about 40 moles of ethylene oxide or propylene oxide may be condensed with the aliphatic alcohol.

The alkyl terminated polyoxyalkylene alcohols useful in the present invention are available commercially under such trade names as "TRITON ®" from Rohm & Haas Company, "Carbowax ®" and "TERGITOL ®" from Union Carbide, "ALFONIC ®" from Conoco Chemicals Company, and "NEODOL ®" from Shell Chemical Company. The TRITON ® materials are identified generally as polyethoxylated alcohols or phenols. The TERGITOLS ® are identified as polyethylene glycol ethers of primary or secondary alcohols; the ALFONIC ® materials are identified as ethoxylated linear alcohols which may be represented by the general structural formula $CH_3(CH_2)_dCH_2(OCH_2CH_2)_eOH$ wherein d varies between 4 and 16 and e is a number between about 3 and 11. Specific examples of ALFONIC ® ethoxylates characterized by the above formula include ALFONIC ® 1012-60 wherein d is about 8 to 10 and e is an average of about 5 to 6; ALFONIC ® 1214-70 wherein d is about 10-12 and e is an average of about 10 to about 11; ALFONIC ® 1412-60 wherein d is from 10-12 and e is an average of about 7; and ALFONIC ® 1218-70 wherein d is about 10–16 and e is an average of about 10 to about 11.

The Carbowax ® methoxy polyethylene glycols are linear ethoxylated polymer of methanol. Examples of these materials include Carbowax ® methoxy polyethylene glycol 350, 550 and 750, wherein the numerical value approximates number average molecular weight.

The NEODOL ® ethoxylates are ethoxylated alcohols wherein the alcohols are a mixture of alcohols containing from 12 to about 15 carbon atoms, and the alcohols are partially branched chain primary alcohols. The ethoxylates are obtained by reacting the alcohols with an excess of ethylene oxide such as from about 3 to about 12 or more moles of ethylene oxide per mole of alcohol. For example, NEODOL ® ethoxylate 23–6.5 is a partially branched chain alcoholate of 12 to 13 carbon atoms with an average of about 6 to about 7 ethoxy units.

In another embodiment, the alkoxy alcohol is a hydroxy amine. The hydroxy amine may be one or more of the above discribed ether amines. In one embodiment, the hydroxy amine is represented by the formula

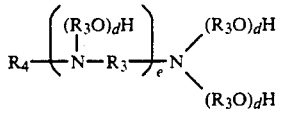

wherein each $R_3$ is an alkylene group, $R_4$ is a hydrocarbyl group; each d is independently an integer from zero to 100, provided at least one d is an integer greater than zero; and e is zero or one.

Preferably, $R_4$ is a hydrocarbyl group having from 8, preferably about 10, to about 30 carbon atoms, preferably to about 24, more preferably to about 18 carbon atoms. $R_4$ is preferably an alkyl or alkenyl group, more preferably an alkenyl group. $R_4$ is preferably an octyl, decyl, dodecyl, tridecyl, tetradecyl, hexadecyl, octadecyl, oleyl, soya or tallow group.

d is preferably 1, preferably 2, more preferably 3 to about 100, preferably about 50, more preferably about 20, more preferably to about 10.

$R_3$ is as described above. Preferably, each $R_3$ is independently an ethylene or propylene group.

The above hydroxyamines can be prepared by techniques well known in the art, and many such hydroxyamines are commercially available. They may be prepared, for example, by reaction of primary amines containing at least 6 carbon atoms with various amounts of alkylene oxides such as ethylene oxide, propylene oxide, butylene oxide, etc. The primary amines may be single amines or mixtures of amines such as obtained by the hydrolysis of fatty oils such as tallow oils, sperm oils, coconut oils, etc. Specific examples of fatty acid amines containing from about 8 to about 30 carbon atoms include saturated as well as unsaturated aliphatic amines such as octyl amine, decyl amine, lauryl amine, stearyl amine, oleyl amine, myristyl amine, palmityl amine, dodecyl amine, and octadecyl amine.

The useful hydroxyamines where e in the above formula is zero include 2-hydroxyethylhexylamine, 2-hydroxyethyloctylamine, 2-hydroxyethylpentadecylamine, 2-hydroxyethyloleylamine, 2-hydroxyethylsoyamine, bis(2-hydroxyethyl)hexylamine, bis(2-hydroxyethyl)oleylamine, and mixtures thereof. Also included are the comparable members wherein in the above formula at least one a is an integer greater than 2, as for example, 2-hydroxyethoxyethylhexylamine.

A number of hydroxyamines wherein e is zero are available from the Armak Chemical Division of Akzona, Inc., Chicago, Ill., under the general trade designation "Ethomeen" and "Propomeen". Specific examples of such products include "Ethomeen C/15" which is an ethylene oxide condensate of a cocoamine containing about 5 moles of ethylene oxide; "Ethomeen C/20" and "C/25" which also are ethylene oxide condensation products from cocoamine containing about 10 and 15 moles of ethylene oxide respectively; "Ethomeen 0/12" which is an ethylene oxide condensation product of oleylamine containing about 2 moles of ethylene oxide per mole of amine. "Ethomeen S/15" and "S/20" which are ethylene oxide condensation products with soyaamine containing about 5 and 10 moles of ethylene oxide per mole of amine respectively; and "Ethomeen T/12, T/15" and "T/25" which are ethylene oxide condensation products of tallowamine containing about 2, 5 and 15 moles of ethylene oxide per mole of amine respectively. "Propomeen O/12" is the condensation product of one mole of oleyl amine with 2 moles propylene oxide. Preferably, the salt is formed from Ethomeen C/15 or S/15 or mixtures thereof.

Commercially available examples of hydroxyamines where e is 1 include "Ethoduomeen T/13", "T/20" and "T/25" which are ethylene oxide condensation products of N-tallow trimethylene diamine containing 3, 10 and 15 moles of ethylene oxide per mole of diamine, respectively.

Another group of alkoxy alcohols are the commercially available liquid TETRONIC polyols sold by BASF Corporation. These polyols are represented by the general formula:

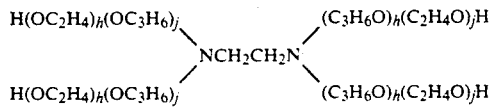

wherein h and j are such that h is a number sufficient to provide a number average moleculer weight of about 3000 to about 12000, preferably 6000, and j is a number sufficient to provide a number average moleculer weight of about 25 to about 85. Examples of these alcoxy alcohols includes Tetronic® 701, 901, 1501, 9OR1 and 150R1 polyols. Such hydroxyamines are described in U.S. Pat. No. 2,979,528 which is incorporated herein by reference. A specific example would be a hydroxyamine having a number average molecular weight of about 8000 wherein the ethyleneoxy groups account for 7.5%-12% by weight of the total number average molecular weight. Such hydroxyamines can be prepared by reacting an alkylene diamine such as ethylene diamine, propylene diamine, hexamethylene diamine etc., with alkylene oxide, such as propylene oxide. Then the resulting product is reacted with ethylene oxide.

In another embodiment, the alkoxy alcohol may be a propoxylated hydrazine. Propoxylated hydrazines are available commercially under the tradename Qxypruf TM. Examples of propoxylated hydrazines include Qxypruf TM 6, 12 and 20 which are hydrazine treated with 6, 12 and 20 moles of propylene oxide, respectively.

In another embodiment, the alkoxy alcohol may be a polyoxyalkylated phenol. The phenol may be substituted or unsubstituted. A preferred polyoxyalkylated phenol is a polyoxyethylated nonylphenol. Polyoxyalkylated phenols are availabe commercially from Rohm and Haas Co. under the tradename Triton® and Texaco Chemical Company under the tradename Surfonic®. Examples of polyoxyalkylated phenols include Triton® Ag-98, N series, and X series polyoxyethylated nonylphenols.

In another embodiment, the alkoxy alcohol may be a polyoxyalkylene fatty ester. Polyoxyalkylene fatty esters may be prepared from any polyoxyalkylene polyol and a fatty acid. Preferably, the polyoxyalkylene polyol is any disclosed herein. The fatty acid is preferably the fatty monocarboxylic acid described above. Polyoxyalkylene fatty esters are available commercially from Armak Company under the tradename Ethofat TM. Specific examples of polyoxyalkylene fatty esters include Ethofat TM C/15 and C/25, which are coco fatty esters formed using 5 and 15 moles, respectively, of ethylene oxide; Ethofat TM O/15 and O/20, which are oleic esters formed using 5 and 10 moles of ethylene oxide; and Ethofat 60/15, 60/20 and 60/25 which are stearic esters formed with 5, 10 and 15 moles of ethylene oxide respectively.

(D) Fluidizing Oil

A fluidizing oil is an oil which functions to maintain flow properties of a lubricant additive. The fluidizing oil helps provide a coherent stable film at high temperatures. The fluidizing oil is believed to function just before and during combustion of the fuel-lubricant mixture in a two-cycle engine. The volatile components of the fuel-lubricant mixture flash off leaving behind the lubricating composition containing additives and oils of lubricating viscosity. The fluidizing oil does not flash off and controls viscosity prior to burning of the fuel-lubricant mixture.

Fluidizing oils may be natural oils or synthetic oils, or mixtures thereof. The natural oils are mineral oils, vegetable oils, animal oils and oils derived from coal or shale. Synthetic oils include hydrocarbon oils, such as alkylated aromatic oils, olefin oligomers, esters including esters of polycarboxylic acids and polyols and the like. Generally, fluidizing oils have good thermal stability and a viscosity greater than 10 centipoise at 100° C. These oils generally have a viscosity index greater than 90. Preferably, the fluidizing oil is a sulfur extracted paraffinic oil containing no more than about 20% unsaturation. Examples of fluidizing oils include circonsol 410, a 100 neutral naphthenic oil having 44.1% aromatic content (available from Sun Oil Company); Sunthene 140, a 100 neutral naphthenic oil having 35% aromatic content (available from Sun Oil Company); Sun solvent refined 115 oil, a 100 neutral paraffinic oil available from Sun Oil Company; SEB-78 and SEB-120 available commercially from the Standard Oil Company; CN-725 available from Sun Oil Company; and 500 and 600 neutral oils from Exxon Corporation.

The present invention also relates to lubricant compositions and fuel-lubricant mixtures for two-cycle engines which contain compositions which comprise (A) at least one dispersant, (B) at least one fatty acid-amine reaction product, (C) at least 25% by weight of the composition of at least one varnish dissolver selected from (a) keto-alcohols, (b) carboxylic esters having up to 24 carbon atoms, and (c) alkoxy alcohols and (D) at least one fluidizing oil. Generally, the compositions are used in fuels in amounts sufficient to release stuck piston rings or increase compression. Compositions are typically used at concentrations of 0.2 ounce, preferably 0.5 ounce, preferably 1 ounce, more preferably 2 ounces up to 6 ounces, preferably 5 ounces, more preferably 4 ounces per gallon. The compositions of the present invention when added to fuels generally release stuck piston rings or increase compression. Even at relatively low treatment levels, the compositions of the present invention have been found to increase compression. In one embodiment, the compositions are used at 0.2 ounce, preferably 0.5 ounce up to 1 ounce per gallon. In this embodiment, the compositions are used together with another two-cycle lubricating composition.

In the compositions used in the present invention, the dispersant (A) is present in an amount from about 5%, preferably about 7%, more preferably about 10% up to about 304, preferably about 25%, more preferably about 20% by weight of the total composition. The composition used for determining the percent by weight is the composition which is added to a fuel. The fatty acid-amine reaction product (B) is generally present in an amount f rom about 2%, preferably about 2.5%, more preferably about 3% up to about 15%, preferably about lot, more preferably about 6%. The varnish dissolvers (C) are present in an amount sufficient to dissolve varnish. Generally, the varnish dissolvers (C) are present in an amount from about 5%, preferably about lot, more preferably about 20% up to about 80%, preferably up to about 70%, preferably up to about 60%, preferably up to about 50% by weight of the composition. The fluidizing oil (D) is generally present in an amount from about 15%, preferably about 20%, more preferably about 25% up to about 70%, preferably about 60%, more preferably about 50% by weight of the composition.

The invention also contemplates the use of other additives in combination with the compositions of this invention. Such additives include, for example, viscosity index (VI) improvers, corrosion- and oxidation-inhibiting agents, coupling agents, pour point depressing agents, extreme pressure agents, antiwear agents, color stabilizers and anti-foam agents.

Extreme pressure agents and corrosion- and oxidation-inhibiting agents which may be included in the lubricants of the invention are exemplified by chlorinated aliphatic hydrocarbons such as chlorinated wax and chlorinated aromatic compounds such as dichlorobenzene; organic sulfides and polysulfides such as benzyl disulfide, bis(chlorobenzyl)disulfide, dibutyl tetrasulfide, sulfurized methyl ester of oleic acid, sulfurized alkylphenol, sulfurized dipentene, and sulfurized terpene; phosphosulfurized hydrocarbons such as the reaction product of a phosphorus sulfide with turpentine or methyl oleate, phosphorus esters including principally dihydrocarbon and trihydrocarbon phosphites such as dibutyl phosphite, diheptyl phosphite, dicyclohexyl phosphite, pentylphenyl phosphite, dipentylphenyl phosphite, tridecyl phosphite, distearyl phosphite, dimethyl naphthyl phosphite, oleyl 4-pentylphenyl phosphite, polypropylene (molecular weight 500)-substituted phenyl phosphite, diisobutyl-substituted phenyl phosphite; metal thiocarbamates, such as zinc dioctyldithiocarbamate, and barium heptylphenyl dithiocarbamate; Group II metal phosphorodithioates such as zinc dicyclohexylphosphorodithioate, zinc dioctylphosphorodithioate, barium di(heptylphenyl)phosphorodithioate, cadmium dinonylphosphorodithioate, and the zinc salt of a phosphorodithioic acid produced by the reaction of phosphorus pentasulfide with an equimolar mixture of isopropyl alcohol and n-hexyl alcohol.

Many of the above-mentioned extreme pressure agents and corrosion-oxidation inhibitors also serve as antiwear agents. Zinc dialkylphosphorodithioates are a well known example.

Pour point depressants are a particularly useful type of additive often included in the lubricating oils described herein. The use of such pour point depressants in oil-based compositions to improve low temperature properties of oil-based compositions is well known in the art. See, for example, page 8 of "Lubricant Additives" by C. V. Smalheer and R. Kennedy Smith (Lezi-us-Hiles Co. publishers, Cleveland, Ohio, 1967).

Examples of useful pour point depressants are polymethacrylates; polyacrylates; polyacrylamides; condensation products of haloparaffin waxes and aromatic compounds; vinyl carboxylate polymers; and terpolymers of dialkylfumarates, vinyl esters of fatty acids and alkyl vinyl ethers. Pour point depressants useful for the purposes of this invention, techniques for their preparation and their uses are described in U.S. Pat. Nos. 2,387,501; 2;015,748; 2,655,479; 1,815,022; 2,191,498; 2,666,746; 2,721,877; 2,721,878; and 3,250,715 which are hereby incorporated by reference for their relevant disclosures.

Anti-foam agents are used to reduce or prevent the formation of stable foam. Typical anti-foam agents include silicones or organic polymers. Additional anti-foam compositions are described in "Foam Control Agents", by Henty T. Kerner (Noyes Data Corporation, 1976), pages 125–162.

Polymeric VI improvers have been and are being used as bright stock replacement to improve lubricant film strength and lubrication and/or to improve engine cleanliness. Dye may be used for identification purposes and to indicate whether a two-cycle fuel contains lubricant. Coupling agents such as organic surfactants are incorporated into some products to provide better component solubilities and improved fuel/lubricant water tolerance.

Anti-wear and lubricity improvers, particularly sulfurized sperm oil substitutes and other fatty acid and vegetable oils, such as castor oil, are used in special applications, such as racing and for very high fuel/lubricant ratios. Scavengers or combustion chamber deposit modifiers are sometimes used to promote better spark plug life and to remove carbon deposits. Halogenated compounds and/or phosphorus-containing materials may be used for this application.

Lubricity agents such as synthetic polymers (e.g., polyisobutene having a number average molecular weight in the range of about 750 to about 15, 000, (as measured by vapor phase osmometry or gel permeation chromatography), polyol ether (e.g., poly(oxyethylene-oxypropylene) ethers) and ester oils (e.g., the ester oils described above) can also be used in the oil compositions of this invention. Natural oil fractions such as bright stocks (the relatively viscous products formed during conventional lubricating oil manufacture f rom petroleum) can also be used f or this purpose. They are usually present in the two-cycle oil in the amount of about 3 to about 20% of the total oil composition.

Diluents such as petroleum naphthas boiling at the range of about 30°–90° (e.g., Stoddard solvent) can also be included in the oil compositions of this invention, typically in the amount of 5 to 25%.

The fuels used in the present invention are well known to those skilled in the art and usually contain a major portion of a normally liquid fuel such as hydrocarbonaceous petroleum distillate fuel (e.g., motor gasoline as defined by ASTM Specification D-439-73). Such fuels can also contain non-hydrocarbonaceous materials such as alcohols, ethers, organs-nitro compounds and the like (e.g., methanol, ethanol, diethyl ether, methyl ethyl ether, nitromethane) are also within the scope of this invention as are liquid fuels derived from vegetable or mineral sources such as corn, alfalfa, shale and coal. Examples of such fuel mixtures are combinations of gasoline and ethanol, diesel fuel and ether, gasoline and nitromethane, etc. Particularly preferred is gasoline, that is, a mixture of hydrocarbons having an ASTM boiling point of 60° C. at the 10% distillation point to about 205° C. at the 90% distillation point.

Two-cycle fuels also contain other additives which are well known to those of skill in the art. These can include anti-knock agents such as tetra-alkyl lead compounds, lead scavengers such as halo-alkanes (e.g., ethylene dichloride and ethylene dibromide), dyes, cetane improvers, antioxidants such as 2,6-di-tertiary-butyl-4-methylphenol, rust inhibitors, such as alkylated succinic acids and anhydrides, bacteriostatic agents, gum inhibitors, metal deactivators, demulsifiers, upper cylinder lubricants, anti-icing agents and the like. The invention is useful with lead-free as well as lead-containing fuels.

The following table contains examples of compositions used in the present invention. The amount of components are based on parts by weight.

TABLE 1

| Product of: | Ex. A | Ex. B | Ex. C | Ex. D |
|---|---|---|---|---|
| Example 2 | | | 10 | |
| Example 6 | | | | 16 |
| Example 8 | | 12 | | |
| Example 12 | 8 | | | |
| Example 15 | | | | |
| Example B-2 | 5.1 | 4.3 | | |
| Example B-3 | | | 5.1 | 4.16 |
| Diacetone alcohol | | | 3.0 | 4.95 |
| Hydroxymethyl-butanone | 6.2 | | 2.0 | |
| Ethyl acetate | 8.0 | | | 10.8 |
| Butoxy ethoxy ethanol | | | 10.0 | |

TABLE 1-continued

| Product of: | Ex. A | Ex. B | Ex. C | Ex. D |
|---|---|---|---|---|
| Butoxy ethanol | | | 1.7 | 4.95 |
| Butoxy ethyl acetate | | | 6.3 | |
| Ethoxyethanol | 7.2 | | | |
| Sunthene 140 | 25.2 | 30 | 10 | 16.5 |
| SEB 78 | 15.1 | 15.2 | 40 | 24.0 |
| Isopropyl alcohol | 10.1 | 7.5 | 5 | 8.61 |
| Xylene | 8.2 | 7.5 | 15 | 9.84 |

While the invention has been described herein with respect to its preferred embodiments and illustrated by the presentation of specific examples, it is to be understood that various modifications thereof will be apparent to those skilled in the art upon reading this specification. It is intended that such modifications are within the scope of the invention which is limited only by the appended claims.

What is claimed is:

1. A method, comprising the steps of:

introducing into a two-cycle internal combustion engine a fuel-lubricant mixture comprising a major amount of a fuel and a minor amount sufficient to increase compression of release stuck piston rings, of a lubricant composition comprising (A) from about 5% up to about 30% by weight of at least one dispersant, (B) from about 2% up to about 15% by weight of at least one reaction product of a fatty acid and a polyamine, further treated with an alkylene oxide, (C) from about 5% up to about 80% by weight of at least one varnish dissolver selected from (a) keto-alcohols, (b) carboxylic esters having up to a total of 24 carbon atoms, and (c) alkoxy alcohols, and (D) from about 15% up to about 70% by weight of at least one fluidizing oil.

2. The method of claim 1, wherein the dispersant (A) is selected from the group consisting of (A-1) aminophenol, (A-2) a reaction product of a nitrophenol and an amino compound, (A-3) a nitrogen-containing carboxylic dispersant, (A-4) an amine dispersant, (A-5) an ester dispersant and (A-6) a Mannich dispersant.

3. The method of claim 1, wherein the dispersant (A) is at least one (A-1) aminophenol which is represented by the formula $$(R)_a-\overset{(OH)_c}{\overset{|}{Ar}}-(NH_2)_b$$

wherein R is a hydrocarbyl substituent having an average of about 10 up to about 400 carbon atoms; (a), (b) and (c) are each independently an integer from 1 up to 3 times the number of aromatic nuclei are present Ar with the proviso that the sum of (a) plus (b) plus (c) does not exceed the unsatisfied valencies of Ar; and Ar is independently an aromatic moiety which has f from 0 to 3 substituents selected from the group consisting of lower alkyl, alkoxyl, nitro, halo or combinations of two or more thereof.

4. The method of claim 3, wherein Ar is a naphthalene nucleus, benzene nucleus or mixtures thereof.

5. The method of claim 3, wherein (a), (b) and (c) are each 1.

6. The method of claim 1, wherein the dispersant (A) is at least one (A-2) reaction product of a nitrophenol and an amino compound, wherein the nitrophenol is represented by the formula $$(R_1)_a-\overset{(OH)_c}{\overset{|}{Ar}}-(NO_2)_b$$

wherein R is a hydrocarbyl substituent having an average of about 10 up to about 400 carbon atoms; (a), (b) and (c) are each independently an integer f from 1 up to 3 times the number of aromatic nuclei present in Ar with the proviso that the sum of (a), (b) and (c) does not exceed the unsatisfied valencies of Ar; and Ar is an aromatic moiety which is substituted by from 0 to 3 substituents selected from the group consisting of lower alkyl, alkoxyl, nitro, halo, or combinations of two or more thereof.

7. The method of claim 6, wherein Ar is a naphthalene nucleus, benzene nucleus or mixtures thereof.

8. The method of claim 1, wherein the dispersant (A) is (A-3) a nitrogen-containing carboxylic dispersant prepared by reacting an amine and a hydrocarbylsubstituted carboxylic acylating agent.

9. The method of claim 1, wherein the dispersant (A) is (A-4) an amine dispersant prepared by reacting a polyamine and a polyalkene.

10. The method of claim 1, wherein the dispersant (A) is (A-5) an ester dispersant prepared by reacting a polyhydroxy compound and a carboxylic acylating agent, and optionally an amine.

11. The method of claim 1, wherein the dispersant (A) is (A-6) a Mannich dispersant prepared by reacting a substituted hydroxy aromatic compound, an aldehyde and a polyamine.

12. The method of claim 1, wherein the fatty acid of the reaction product (B) contains from 12 to about 24 carbon atoms.

13. The method of claim 1, wherein the polyamine of the reaction product (B) is an alkylene polyamine.

14. The method of claim 1, wherein the varnish dissolver (C) is (a), and the keto-alcohol is hydroxyacetone, diacetone alcohol, hydroxymethylpentanone or hydroxymethylbutanone.

15. The method of claim 1, wherein the varnish dissolver (C) is (b), and the carboxylic ester is prepared from carboxylic acids having from 2 to about 8 carbon atoms and alcohols having from 1 to about 8 carbon atoms.

16. The method of claim 1, wherein the varnish dissolver (C) is (c), and the alkoxy alcohol is ethoxyethanol, ethoxypropanol, butoxyethanol or butoxypropanol.

17. The method of claim 1, wherein the varnish dissolver comprises at least two of (a), (b) and (c).

18. The method of claim 1, wherein the varnish dissolver (C) is a mixture of (a), (b), and (c).

19. A method, comprising the steps of:

introducing into a two-cycle internal combustion engine a fuel-lubricant mixture comprising a major amount of a fuel and from about 0.2 to about 6 ounces per gallon of a composition comprising (A-1) from about 5% up to about 30% by weight of at least one aminophenol represented by the formula:

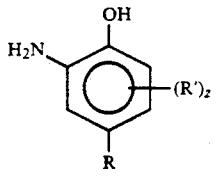

wherein R is a hydrocarbyl group having an average of about 30 to about 400 aliphatic carbon atoms; R′ is selected from the group consisting of lower alkyl, lower alkoxy, nitro, and halo; and z is 0 or 1;

(B) from about 2% up to about 15% by weight of at least one reaction product of a fatty acid and a polyamine, further treated with an alkylene oxide;

(C) from about 5% up to about 80% by weight of at least one varnish dissolver selected from (a) keto-alcohols, (b) carboxylic esters having up to a total of 24 carbon atoms, and (c) alkoxy alcohols, and (D) from about 15% up to about 70% by weight of the composition of at least one fluidizing oil.

20. The method of claim 19, wherein z is 0.

21. The method of claim 19, wherein the polyamine of the reaction product (B) is an alkylene polyamine.

22. The method of claim 19, wherein the fatty acid of the reaction product (B) has from about 12 to about 24 carbon atoms.

23. The method o claim 19, wherein the fatty acid of the reaction product (B) is stearic acid.

24. The method of claim 19, wherein the varnish dissolver (C) is (a), and the keto-alcohol is hydroxy acetone, diacetone alcohol, hydroxymethylpentanone or hydroxymethylbutanone.

25. The method of claim 19, wherein the varnish dissolver (C) is (b), and the carboxylic ester is prepared from carboxylic acids having from 2 to about 8 carbon atoms and alcohols having from 1 to about 8 carbon atoms.

26. The method of claim 19, wherein the varnish dissolver (C) is (b), and the carboxylic ester is methyl, ethyl, propyl or butyl acetate.

27. The method of claim 19, wherein the varnish dissolver (C) is (C), and the alkoxy alcohol is ethoxyethanol, ethoxypropanol, butoxyethanol or butoxypropanol.

28. The method of claim 19, wherein the varnish dissolver (C) is a mixture of (a), (b) and (c).

29. The composition of claim 19, wherein the varnish dissolver (C) is a mixture of (a), (b) and (c), wherein (a), the keto-alcohol is hydroxy acetone, diacetone alcohol, hydroxymethylpentanone or hydroxymethylbutanone, (b) is a carboxylic ester prepared from carboxylic acids having from 2 to about 8 carbon atoms and alcohols having from 1 to about 8 carbon atoms, and (c), the alkoxy alcohol is ethoxyethanol, ethoxypropanol, butoxyethanol or butoxypropanol.

30. A two-cycle engine lubricant composition, comprising (A) from about 5% up to about 30% by weight of at least one dispersant, (B) from about 2% up to about 15% by weight of the reaction product of a fatty acid and a polyamine, further treated with an alkylene oxide, (C) from about 5% up to about 80% by weight of at least one varnish dissolver selected from (a) keto-alcohols, (b) carboxylic esters having up to a total of 24 carbon atoms, and (c) alkoxy alcohols, and (D) from about 15% up to about 70% by weight of at least one fluidizing oil.

31. A fuel lubricant mixture, comprising a major amount of a fuel and an amount, sufficient, to increase compression or release stuck piston rings of a two cycle engine, of the lubricant of claim 30.

32. A method, comprising the steps of:

introducing into a two-cycle internal combustion engine a fuel-lubricant mixture comprising a major amount of a fuel and a minor amount sufficient to increase compression or release stuck piston rings, of a lubricant composition comprising (A) from about 5% up to about 30% by weight of at least one dispersant, (B) from about 2% up to about 15% by weight of at least one reaction product of a fatty acid and a polyamine, (C) from about 5% up to about 80% by weight of at least one varnish dissolver selected from (a) keto-alcohols selected from the group consisting of hydroxyacetone, diacetone alcohol, hydroxymethylpentanone and hydroxymethylbutanone, and (c) alkoxy alcohols selected from the group consisting of ethoxyethanol, ethoxypropanol, butoxyethanol and butoxypropanol, and (D) from about 15% up to about 70% by weight of at least one fluidizing oil.

33. The method of claim 32, wherein the dispersant (A) is selected from the group consisting of (A-1) aminophenol, (A-2) a reaction product of a nitrophenol and an amino compound, (A-3) a nitrogen-containing carboxylic dispersant, (A-4) an amine dispersant, (A-5) an ester dispersant and (A-6) a Mannich dispersant.

34. The method of claim 32, wherein the dispersant (A) is at least one (A-1) aminophenol which is represented by the formula $$(R)_a-\overset{(OH)_c}{\overset{|}{Ar}}-(NH_2)_b$$

wherein R is a hydrocarbyl substituent having an average of about 10 up to about 400 carbon atoms; (a), (b) and (c) are each independently an integer from 1 up to 3 times the number of aromatic nuclei present in Ar with the proviso that he sum of (a) plus (b) plus (c) does not exceed the unsatisfied valencies of Ar; and Ar is independently an aromatic moiety which has from 0 to 3 substituents selected from the group consisting of lower alkyl, alkoxyl, nitro, halo or combinations of two or more thereof.

35. The method of claim 34, wherein Ar is a naphthalene nucleus, benzene nucleus or mixtures thereof.

36. The method of claim 34, wherein (a), (b) and (c) are each 1.

37. The method of claim 32, wherein the dispersant (A) is at least one (A-2) reaction product of a nitrophenol and an amino compound, wherein the nitrophenol is represented by the formula $$(R_1)_a-\overset{(OH)_c}{\overset{|}{Ar}}-(NO_2)_b$$

wherein R is a hdyrocarbyl substituent having an average of about 10 up to about 400 carbon atoms; (a), (b)

and (c) are each independently an integer from 1 up to 3 times the number of aromatic nuclei present in Ar with the proviso that the sum of (a), (b) and (c) does not exceed the unsatisfied valencies of Ar; and Ar is an aromatic moiety which is substituted by from 0 to 3 substituents selected from the group consisting of lower alkyl alkoxyl, nitro, halo, or combinations of two or more thereof.

38. The method of claim 37, wherein Ar is a naphthalene nucleus, benzene nucleus or mixtures thereof.

39. The method of claim 32, wherein the dispersant (A) is (A-3) a nitrogen-containing carboxylic dispersant prepared by reacting an amine and a hydrocarbyl-substituted carboxylic acylating agent.

40. The method of claim 32, wherein the dispersant (A) is (A-4) an amine dispersant prepared by reacting a polyamine and a polyalkene.

41. The method of claim 32, wherein the dispersant (A) is (A-5) an ester dispersant prepared by reacting a polyhydroxy compound and a carboxylic acylating agent, and optionally an amine.

42. The method of claim 32, wherein the dispersant (A) is (A-6) a Mannich dispersant prepared by reacting a substituted hydroxy aromatic compound, an aldehyde and a polyamine.

43. The method of claim 32, wherein the fatty acid of the reaction product (B) contains from 12 to about 24 carbon atoms.

44. The method of claim 32, wherein the polyamine of the reaction product (B) is alkylene polyamine.

45. The method of claim 32, wherein the reaction product is further treated with an alkylene oxide.

46. The method of claim 32, wherein the varnish dissolver (C) comprises at least two of (a), (b) and (c) wherein (a) the keto-alcohol is hydroxyacetone, diacetone alcohol, hydroxymethylpentanone or hydroxymethylbutanone, (b) is a carboxylic ester prepared from carboxylic acids having from 2 to about 8 carbon atoms and alcohols having from 1 to about 8 carbon atoms, and (c) the alkoxy alcohol is ethoxyethanol, ethoxypropanol, butoxyethanol or butoxypropanol.

47. The method of claim 46, wherein the varnish dissolver (C) is a mixture of (a), (b), and (c).

48. A method, comprising the steps of:

introducing into a two-cycle internal combustion engine a fuel-lubricant mixture comprising a major amount of a fuel and from about 0.2 to about 6 ounces per gallon of a composition comprising (A-1) from about 5% up to about 30% by weight of at least one aminophenol represented by the formula:

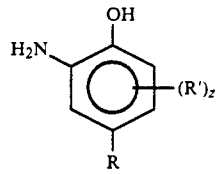

wherein R is a hydrocarbyl group having an average of about 30 to about 400 aliphatic carbon atoms; R′ is selected from the group consisting of lower alkyl, lower alkoxy, nitro, and halo; and z is 0 or 1;

(B) from about 2% up to about 15% by weight of at least one reaction product of a fatty acid and a polyamine; and (C) from about 5% up to about 80% by weight of at least one varnish dissolver selected from (a) keto-alcohols, selected from the group consisting of hydroxyacetone, diacetone alcohol, hydroxymethylpentanone and hydroxymethylbutanone, and (c) alkoxy alcohols selected from the group consisting of ethoxyethanol, ethoxypropanol, butoxyethanol and butoxypropanol, and (D) from about 15% up to about 70% by weight of the composition of at least one fluidizing oil.

49. The composition of claim 48, wherein z is 0.

50. The composition of claim 48, wherein the polyamine of the reaction product (B) is an alkylene polyamine.

51. The method of claim 48, wherein the fatty acid of the reaction product (B) has from about 12 to about 24 carbon atoms.

52. The method of claim 48, wherein the fatty acid of the reaction product (B) is stearic acid.

53. The method of claim 48, wherein the reaction product (B) is further treated with an alkylene oxide.

54. A two-cycle engine lubricant composition, comprising (A) from about 5% up to about 30% by weight of at least one dispersant, (B) from about 2% up to about 15% by weight of the reaction product of a fatty acid and a polyamine, and (C) from about 5% up to about 80% by weight of at least one varnish dissolver selected from (a) keto-alcohols selected from the group consisting of hydroxyacetone, diacetone alcohol, hydroxymethylpentanone and hydroxymethylbutanone, and (c) alkoxy alcohols selected from the group consisting of ethoxyethanol, ethoxypropanol, butoxyethanol and butoxypropanol, and (D) from about 15% up to about 70% by weight of at least one fluidizing oil.

55. A fuel lubricant mixture, comprising a major amount of a fuel and an amount, sufficient to increase compression or release stuck piston rings of a two-cycle engine, of the lubricant of claim 54.

* * * * *